US010556762B2

(12) United States Patent
Ogata et al.

(10) Patent No.: US 10,556,762 B2
(45) Date of Patent: Feb. 11, 2020

(54) SHEET CONVEYING APPARATUS, IMAGE FORMING APPARATUS, AND IMAGE READING APPARATUS

(71) Applicant: CANON KABUSHIKI KAISHA, Tokyo (JP)

(72) Inventors: Atsushi Ogata, Mishima (JP); Motohiro Furusawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/135,517

(22) Filed: Sep. 19, 2018

(65) Prior Publication Data

US 2019/0100392 A1 Apr. 4, 2019

(30) Foreign Application Priority Data

Oct. 3, 2017 (JP) ..... 2017-193777

(51) Int. Cl.
*B65H 85/00* (2006.01)
*B65H 3/06* (2006.01)
(Continued)

(52) U.S. Cl.
CPC ..... *B65H 3/0669* (2013.01); *G03G 15/0216* (2013.01); *G03G 15/2028* (2013.01); *G03G 15/6511* (2013.01); *B65H 29/58* (2013.01); *B65H 85/00* (2013.01); *B65H 2301/3332* (2013.01); *B65H 2404/144* (2013.01)

(58) Field of Classification Search
CPC ..... B65H 5/062; B65H 5/26; B65H 29/125; B65H 29/58; B65H 85/00; B65H 2301/3332; B65H 2404/144
See application file for complete search history.

(56) References Cited

U.S. PATENT DOCUMENTS 5,031,893 A * 7/1991 Yoneda ..... B41J 13/0045 271/184
5,690,325 A * 11/1997 Morimoto ..... B65H 15/00 271/186

(Continued)

FOREIGN PATENT DOCUMENTS

JP 2005067776 A 3/2005
JP 2008285279 A 11/2008
JP 2015083353 A 4/2015

*Primary Examiner* — Howard J Sanders

(74) *Attorney, Agent, or Firm* — Canon U.S.A., Inc. IP Division

(57) ABSTRACT

A sheet conveying apparatus includes first, second, and third rotating members, a switching unit, and a regulating member. The first rotating member rotates in one direction to convey, with the second rotating member, a sheet in a first direction and convey, with the third rotating member, the sheet in a second direction different from the first direction. The switching unit switches the first rotating member between first and second positions. The first position is a position in which the first rotating member coveys a sheet with the second or third rotating member. The second position is a position to which the first rotating member is retracted from the first position. Where the first rotating member moves from the first position, the regulating member regulates the sheet position so that a sheet rear end held by the second and third rotating members is positioned above a first rotating member moving trajectory.

18 Claims, 21 Drawing Sheets

(51) Int. Cl.

| | |
|---|---|
| ***G03G 15/20*** | (2006.01) |
| ***G03G 15/02*** | (2006.01) |
| ***G03G 15/00*** | (2006.01) |
| *B65H 29/58* | (2006.01) |

(56) References Cited

U.S. PATENT DOCUMENTS

| | | | | |
|---|---|---|---|---|
| 6,244,591 | B1 * | 6/2001 | Paulat | B65H 15/00 271/184 |
| 9,296,585 | B2 * | 3/2016 | Yamada | B65H 85/00 |
| 10,087,029 | B2 * | 10/2018 | Ogata | B65H 15/00 |
| 10,106,350 | B2 * | 10/2018 | Furusawa | G03G 15/231 |
| 2002/0158404 | A1 * | 10/2002 | Carter | B65H 15/00 271/186 |
| 2002/0163121 | A1 * | 11/2002 | Sette | B65H 5/06 271/303 |
| 2018/0305151 | A1 * | 10/2018 | Ogata | B65H 85/00 |
| 2019/0064722 | A1 * | 2/2019 | Ogata | G03G 15/602 |

* cited by examiner

SHEET CONVEYING APPARATUS, IMAGE FORMING APPARATUS, AND IMAGE READING APPARATUS

BACKGROUND

Field of the Disclosure

The present disclosure relates to a sheet conveying apparatus that conveys sheets in a continuous manner, to an image forming apparatus, such as a copier, a printer, or a facsimile, that includes the sheet conveying apparatus, and to an image reading apparatus.

Description of the Related Art

In recent years, measures to further save resources are awaited in image forming apparatuses and double-side printing on sheets, such as paper, an overhead projector (OHP) sheet, a plastic sheet, and fabric, is frequently performed. Accordingly, in an image forming apparatus that has a double-side printing function, importance is placed on improving the number of sheets output per unit time in double-side printing, in other words, importance is placed on improving the productivity of both-side printing.

Japanese Patent Laid-Open No. 2015-083353 discloses a configuration in which a group of reversing rollers that include a single driving roller that receives a driving force and that rotates only in one direction, a first driven roller, and a second driven roller is provided in a reversing unit that reverses a sheet. Regarding the configuration of the group of reversing rollers, three rollers are arranged in the order of the first driven roller, the driving roller, and the second driven roller to be aligned in a substantially straight line in a direction intersecting a sheet conveying direction. The first driven roller opposing the driving roller forms a first nip portion, and the second driven roller opposing the driving roller from a direction different from that of the first driven roller forms a second nip portion.

Sheet reversing is performed in the following manner in the reversing unit in Japanese Patent Laid-Open No. 2015-083353. A sheet on which an image has been formed on a first surface is first conveyed towards the first nip portion in the group of reversing rollers. Subsequently, in the first nip portion, the sheet is conveyed in a first direction that is a direction in which the sheet is discharged from the group of reversing rollers, and a rear end of the sheet in the sheet conveying direction passes the first nip portion. A switchback portion that temporarily accommodates the sheet is provided in the reversing unit at a portion downstream of the first nip portion in the sheet conveying direction, and the sheet that has passed through the first nip portion is accommodated in the switchback portion. Subsequently, by having the sheet accommodated in the switchback portion fall by its own weight, the rear end of the sheet is guided to the second nip portion in the group of reversing rollers. Since the driving roller rotates only in one direction, the sheet nipped by the second nip portion is conveyed in a second direction that is a direction opposite the first direction, which is the conveying direction in the first nip portion. Subsequently, the sheet is conveyed to an image forming unit once again and after an image is formed on a second surface of the sheet, the sheet is conveyed to a sheet discharge unit that is provided at a position that is different from that of the reversing unit. Subsequently, the sheet is discharged from the inside of the image forming apparatus with discharge rollers of the sheet discharge unit.

However, in the configuration of Japanese Patent Laid-Open No. 2015-083353, since the reversing of the sheet is performed by moving the rear end of the sheet to the second nip portion with the weight of the sheet itself after the sheet is completely discharged from the first nip portion in the group of reversing rollers to the switchback portion, the following issue occurs. In other words, the sheet conveying performance may decrease when the rear end of the sheet is not surely nipped by the second nip portion due to the difference in the sheet thickness or the sheet grammage, or because there was or there was no flexure (a curl) in the sheet.

SUMMARY

The present disclosure provides a sheet conveying apparatus that is capable of suppressing decrease in the sheet conveying performance.

According to an aspect of the present disclosure, a sheet conveying apparatus includes a first rotating member configured to rotate in one direction, a second rotating member configured to convey a sheet in a first direction together with the first rotating member according to the first rotating member rotating, a third rotating member configured to convey the sheet in a second direction together with he first rotating member according to the first rotating member rotating, wherein the second direction is a direction different from the first direction, a switching unit configured to switch a position of the first rotating member between a first position and a second position, wherein the first position is a position in which the first rotating member coveys a sheet with the second rotating member or the third rotating member and the second position is a position to which the first rotating member is retracted from the first position, and a regulating member configured to regulate a position of the sheet, wherein, in a case where the first rotating member moves from the first position, the regulating member regulates the position of the sheet so that a rear end of the sheet held by the second rotating member and the third rotating member is, in a gravitational direction, positioned above a moving trajectory of the first rotating member.

Further features of the present disclosure will become apparent from the following description of embodiments with reference to the attached drawings.

DESCRIPTION OF THE EMBODIMENTS

Figure 1:
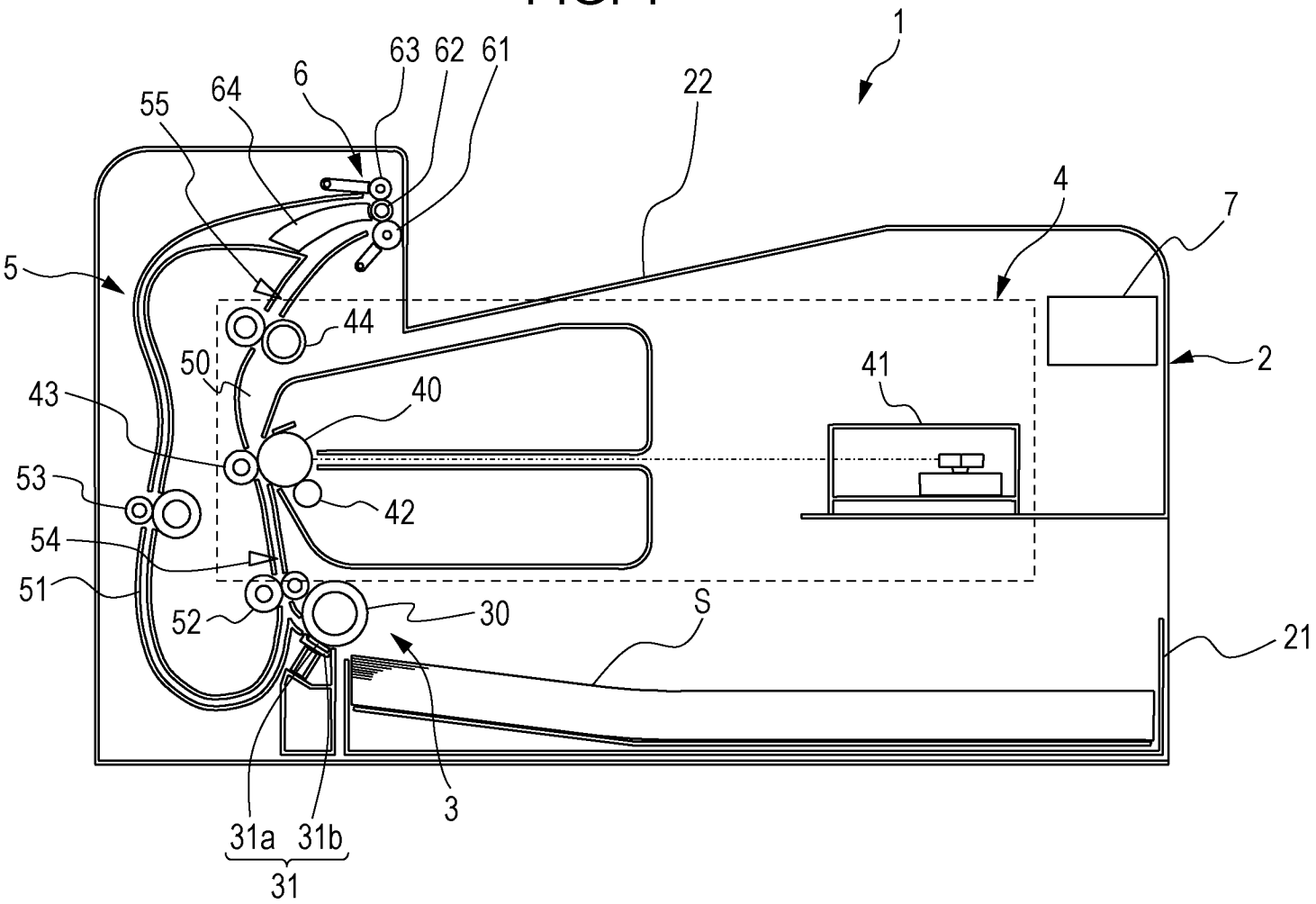
FIG. 1 is a schematic cross-sectional view illustrating an overall configuration of an image forming apparatus according to a first embodiment.

Hereinafter, referring to the drawings, embodiments of the present disclosure will be exemplified in detail. Note that described in the embodiments below are examples in which a laser beam printer including a sheet conveying apparatus of the present disclosure is used. Note that the components described in the embodiments below are for exemplification only and the above components are not to limit the scope of the present disclosure.

First Embodiment

FIG. 1 is a schematic cross-sectional view illustrating a configuration of an image forming apparatus 1 provided with a sheet conveying apparatus of the present embodiment. As illustrated in FIG. 1, the image forming apparatus 1 includes a main body 2 of the image forming apparatus 1, a feed unit 3, an image forming unit 4, a conveying unit 5, a reversing unit 6, and a control unit 7.

The main body 2 accommodates the feed unit 3, the image forming unit 4, the conveying unit 5, the reversing unit 6, and the control unit 7. A sheet feeding cassette 21 serving as a storage portion is detachably provided upstream of the feed unit 3 in a sheet conveying direction, and feeds sheets S accommodated therein in a stacked manner to the feed unit 3. A sheet discharge tray 22 serving as a stack unit on which the sheets S discharged from the main body 2 after image formation has been completed are stacked is provided downstream of the reversing unit 6 in the sheet conveying direction.

The feed unit 3 includes a feed roller 30, and a separating unit 31 including a separating pad 31*a* and a separating holder 31*b* that holds the separating pad 31*a*. The separating pad 31*a* is in pressure contact with the feed roller 30, and the sheets S accommodated in the sheet feeding cassette 21 are fed to the separating unit 31 with the rotation of the feed roller 30, and is fed to a first conveyance path 50 after being separated sheet by sheet in the separating unit 31.

The image forming unit 4 includes a photosensitive drum 40 serving as an image bearing member, a laser scanner unit 41, a developing unit 42, a transfer roller 43, and as fixing unit 44. An electrostatic latent image is formed on a surface of the photosensitive drum 40 by emitting, on the photosensitive drum 40 that has been uniformly charged by a charging device (not shown), a laser beam from the laser scanner unit 41 based on image information. A toner image is formed on the surface of the photosensitive drum 40 by developing the electrostatic latent age with the developing unit 42. The developed toner image is transferred onto the sheet S with the transfer roller 43, and is fixed to the sheet S by being heated and compressed by the fixing unit 44. An image is formed on the sheet S in the above manner in the image forming unit 4.

Figure 2:
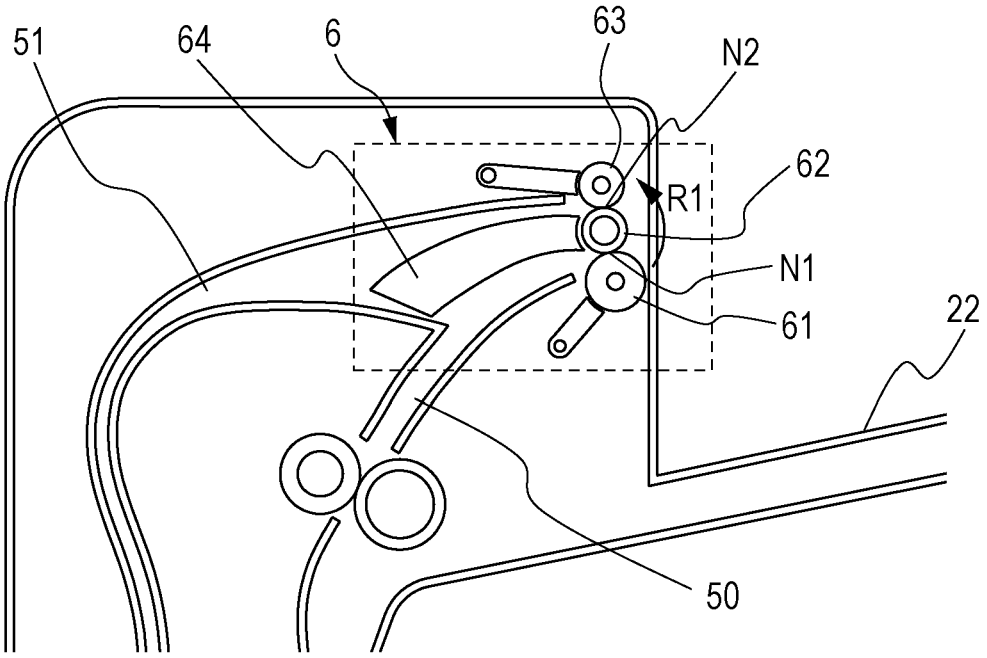
FIG. 2 is a schematic cross-sectional view illustrating a reversing unit according to the first embodiment.

FIG. 2 is a cross-sectional view schematically illustrating a configuration of the reversing unit 6 of the present embodiment. Referring hereinafter to FIG. 2, the configuration of the reversing unit 6 will be described. The reversing unit 6 includes a driving roller 62 (a first rotating member) that receive driving force from a drive source and that only rotates in one direction (an arrow R1 direction in the drawing), and discharge rollers 61 (second rotating members) and reversing rollers 63 (third rotating members) that follow the rotation of the driving roller 62.

The discharge rollers 61 abutting against the driving roller 62 form first nip portions N1. The discharge rollers 61 together with the driving roller 62 nip and convey the sheet S in the first nip portions N1. Furthermore, the reversing rollers 63 abutting against the driving roller 62 at positions that are different from the positions of the discharge rollers 61 in a circumferential direction of the driving roller 62 form second nip portions N2. The reversing roller 63 together with the driving roller 62 nip and convey the sheet S.

By rotating the driving roller 62, the driving roller 62 and the discharge rollers 61 convey the sheet S from the driving roller 62 towards the sheet discharge tray 22, and discharge the sheet S through the first nip portions N1. Note that a direction extending from the first nip portions N1 towards the sheet discharge tray 22 in which the sheet S is discharged is referred to as a discharge direction (a first direction). Furthermore, since the driving roller 62 receiving the driving force only rotates in one direction, the sheet S is conveyed in the second nip portions N2 from the sheet discharge tray 22 towards a second conveyance path 51. In other words, in the second nip portions N2, the sheet S is conveyed in a reverse direction (a second direction) that is a direction different from the conveying direction in the first nip portions N1. Note that the second direction is a direction that conveys the sheet S, which has been conveyed towards the sheet discharge tray 22 in the discharge direction, towards the reversing unit 6 side from the sheet discharge tray 22.

In other words, by having the driving roller 62 rotate only in one direction (the arrow R1 direction in the drawing), the sheet S is conveyed in the first direction at the first nip portions N1, and the sheet S is, at the second nip portions N2, conveyed in the second direction that is a direction opposite to the first direction. Furthermore, by having the reversing unit 6 move the driving roller 62, the sheet S is switched from a state in which the sheet S is nipped by the first nip portions N1 to a state in which the sheet S is nipped by the second nip portions N2. The operation of moving the driving roller 62, which switches the nipped state of the sheet S, will be described in detail later.

As illustrated in FIG. 1, the conveying unit 5 includes the first conveyance path 50, the second conveyance path 51, a first pair of conveyance rollers 52, a second pair of conveyance rollers 53, a first sensor 54, and a second sensor 55.

The first conveyance path 50 is a conveyance path that conveys the sheet S to the image forming unit 4 to form, again, an image on the sheet S that has been fed from the sheet feeding cassette 21 or the sheet S that has been conveyed in the reverse direction with the reversing unit 6. In the conveying direction of the sheet S, the downstream side of the first conveyance path 50 is connected to the first nip portions N1 of the reversing unit 6, and the upstream side of the first conveyance path 50 is bifurcated. A first side of the bifurcated first conveyance path 50 is connected to the sheet feeding cassette 21. The sheet S is fed from the sheet feeding cassette 21 to the first conveyance path 50, and a toner image is transferred onto the sheet S in the image forming unit 4 with the transfer roller 43. Furthermore, a second side of the bifurcated first conveyance path 50 is connected to the second conveyance path 51. The second conveyance path 51 is a conveyance path for conveying the sheet S conveyed in the reverse direction with the reversing unit 6 to the first conveyance path 50 once again in the sheet conveying direction, the upstream side of the second conveyance path 51 is connected to the second nip portions N2 of the reversing unit 6, and the downstream side of the second conveyance path 51 is connected to the second side of the bifurcated first conveyance path 50.

The first pair of conveyance rollers 52 are disposed in the first conveyance path 50, and convey the sheet S fed or conveyed to the first conveyance path 50 along the first conveyance path 50. The second pair of conveyance rollers 53 are disposed in the second conveyance path 51, and convey the sheet S conveyed to the second conveyance path 51 to the first conveyance path 50.

The first sensor 54 is disposed in the first conveyance path 50 at a portion between the feed unit 3 and the image forming unit 4, and detects positions of a front end and a rear end of the sheet S passing through the first sensor 54. The second sensor 55 is disposed downstream of the first conveyance path 50 in the sheet conveying direction and, similar to the first sensor 54, is a detection member that detects the positions of the front end and the rear end of the sheet S passing the second sensor 55. The first sensor 54 and the second sensor 55 of the present embodiment include a sensor flag (not shown) that is biased in a direction that abuts the sensor flag against the sheet S and that turns the sensor flag when the sheet S passes therethrough, and a photo-interrupter (not shown) serving as an optical sensor. In such a configuration, the passing sheet S pushes down and turns the sensor flag, and the sensor flag covers and exposes the detection area of the photo-interrupter, which allows the front end and the rear end of the sheet to be detected.

Note that in the present embodiment, a sensor provided with a sensor flag that turns when the sheet S passes through is used as the first sensor 54 and the second sensor 55; however, the sensor detecting the front end and the rear end of the sheet S is not limited to the above. For example, as the first sensor 54 and the second sensor 55, an optical sensor may be used in which the optical sensor detects the presence of a sheet S by hitting light on the sheet S from a light emitting element and receiving the transmitted light or the reflected light with a light receiving element.

A reversing guide 64 is a guide member that guides the conveyed sheet S. The reversing guide 64 guides the sheet S fed from the sheet feeding cassette 21 to the first nip portions N1, and guides the sheet S conveyed in the second direction at the second nip portions N2 to the second conveyance path 51.

The control unit 7 is capable of controlling the drive of the feed roller 30, the first pair of conveyance rollers 52, the second pair of conveyance rollers 53, and the reversing unit 6, which is related to the conveyance of the sheet 5, and is capable of controlling the operation related to moving the driving roller 62 in the reversing unit 6. The control of the operation of the reversing unit 6 with the control unit 7 will be described in detail later.

Figure 3A:
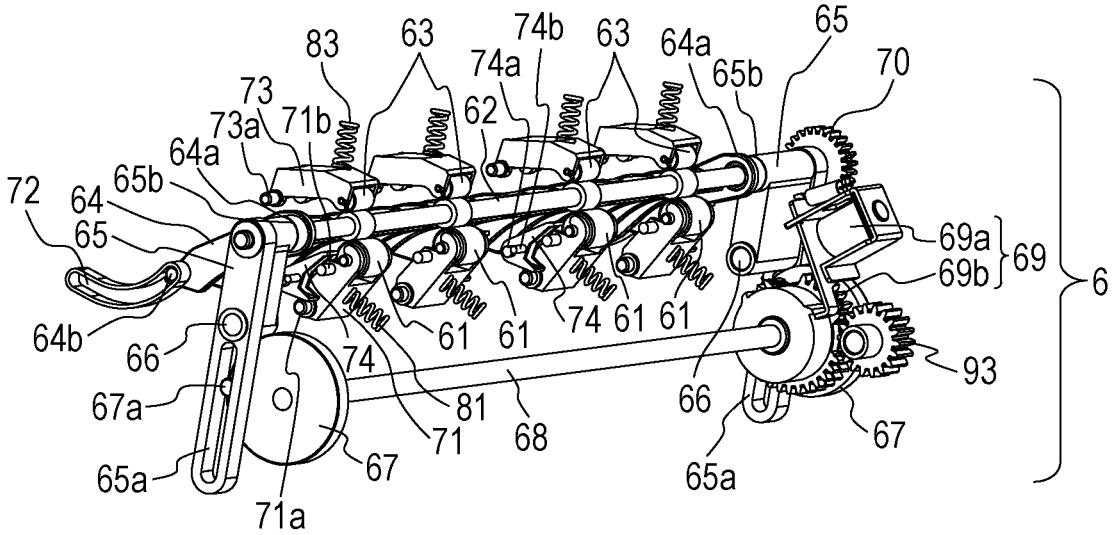
FIGS. 3A and 3B are schematic diagrams illustrating a configuration of the reversing unit according to the first embodiment.
Figure 3B:
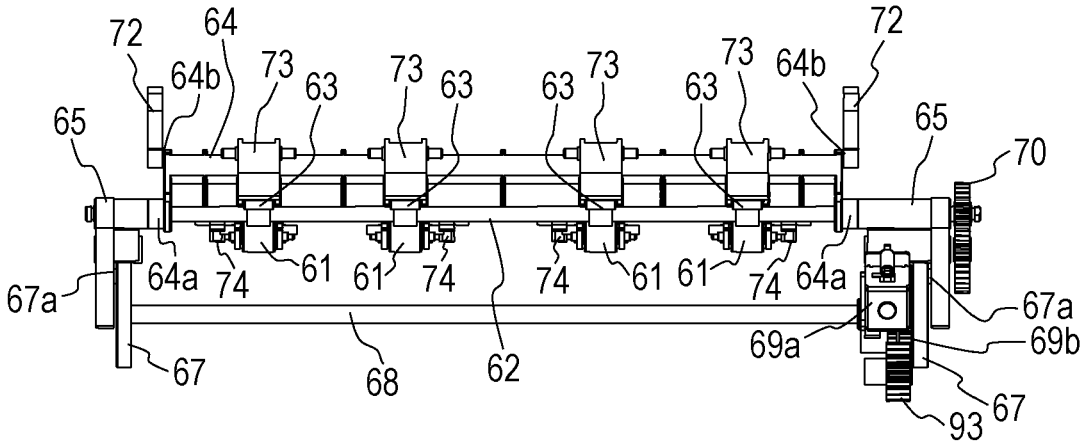
Figure 4:
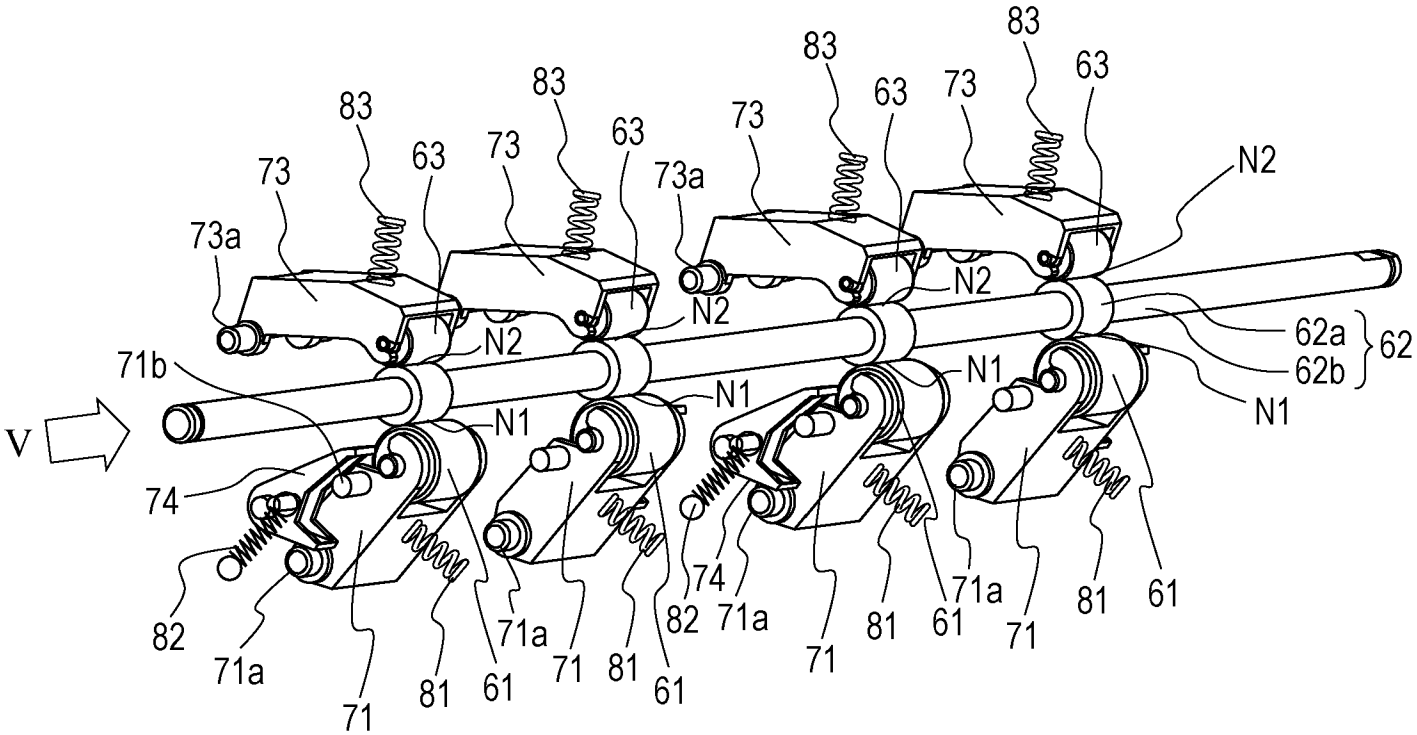
FIG. 4 is a schematic diagram illustrating configurations of rotating members in the reversing unit of the first embodiment.

The configuration of the reversing unit 6 of the present embodiment will be described next with reference to FIGS. 3A, 3B, 4, 5, and 6. FIG. 3A is a schematic diagram illustrating a configuration of the reversing unit 6 of the present embodiment viewed from the downstream side in the sheet conveying direction, and FIG. 3B is a schematic diagram of the reversing unit 6 in FIG. 3A viewed from obliquely above and from the downstream side in the sheet conveying direction. FIG. 4 is a schematic diagram illustrating a configuration of the discharge rollers 61, the driving roller 62, the reversing rollers 63, and a portion around the above members according to the present embodiment.

As illustrated in FIGS. 3A and 3B, the reversing guide 64 is supported by both ends of the driving roller 62 in an axial direction of the driving roller 62, which is a width direction of the conveyed sheet S. Furthermore, in a direction orthogonal to the axial direction of the driving roller 62, first end portions 64*a* of the reversing guide 64, which supported by the driving roller 62, are pivotably held by bearings 65*b* of driving roller holders 65. Meanwhile, cylindrical protrusions 64*b* are provided on second end portions of the reversing guide 64 and on the opposite side of the first end portions in the direction orthogonal to the axial direction of the driving roller 62. Note that the protrusions 64*b* are provided at both end portions of the reversing guide 64 in the axial direction of the driving roller 62 and are fitted to groove portions 72 provided in a main body frame (not shown). The groove portions 72 are provided in the main body frame (not shown) at both ends of the driving roller 62 in the axial direction.

A cam shaft 68 that is provided to oppose the driving roller 62 in a substantially parallel manner penetrates the main body frame (not shown). Rotatable cams 67 are provided at both ends of the cam shaft 68 integral with the cam shaft 68. The cams 67 each include a cylindrical protrusion 67*a* on a surface different from the surface holding the cam shaft 68. The protrusions 67*a* fitted in the guide grooves 65*a* connect the cams 67 and the driving roller holders 65 to each other. Furthermore, a cam drive unit 69 capable of switching the drive operation and that rotates the cams 67 are provided on a first end side of the cam shaft 68. The cam drive unit 69 is formed of a solenoid 69*a* (a switching member) and a partially-toothless gear 69*b*.

The partially-toothless gear 69*b* is capable of being rotated by receiving drive from a drive motor 90 (illustrated in FIG. 7), serving as a drive source, through an input gear 93. The drive operation that rotates the cams 67 is switched in the cam drive unit 69 by engaging a movable piece a1 of the solenoid 69*a* with a locking portion provided in the partially-toothless gear 69*b*. Note that in the present embodiment, a configuration including the partially-toothless gear 69*b* and the movable piece a1 of the solenoid 69*a* is used as the clutch configuration of the cam drive unit 69; however, not limited to the above, a typical clutch, for example, a spring clutch that uses thinness of the spring may be used.

As illustrated in FIG. 4, the discharge rollers 61 abutting against the driving roller 62 form the first nip portions N1 and are held by discharge roller holders 71 (holding members) that are movable about fulcrums 71*a*. The discharge roller holders 71 are urged against the driving roller 62 with springs 81 (first urging members) stretched across to the main body 2, and the driving roller 62 being pressed by the discharge rollers 61 forms the first nip portions N1.

Furthermore, the reversing rollers 63 abutting against the driving roller 62 form the second nip portions N2 and are held by reversing roller holders 73 that are movable about fulcrums 73*a*. The reversing roller holders 73 are urged against the driving roller 62 with springs 83 (third urging members) stretched across to the main body 2, and the driving roller 62 being pressed by the reversing rollers 63 forms the second nip portions N2.

Figure 5:
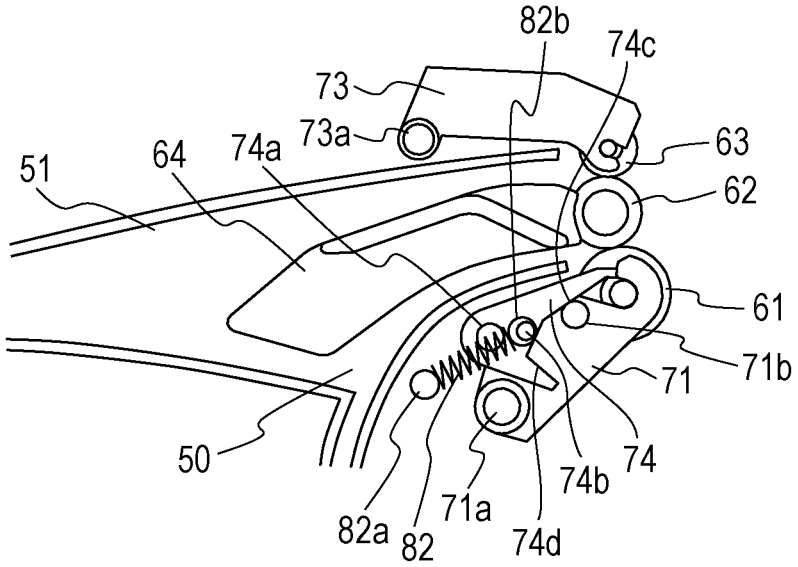
FIG. 5 is a schematic diagram illustrating a configuration of a regulating member according to the first embodiment.

FIG. 5 is a schematic cross-sectional view of the reversing unit 6 illustrated in an enlarged manner viewed in a V-direction in FIG. 4. As illustrated in FIG. 5, levers 74 serving as regulating members that regulate the position of the sheet S by contacting the conveyed sheet S are provided in the vicinities of the discharge rollers 61. As illustrated in FIGS. 3A, 3B, and 4, in the present embodiment, a plurality of levers 74 are disposed in an axial direction of the driving roller 62.

Similar to the discharge roller holders 71, the levers 74 are, relative to the main body 2, held in a rotatable manner about rotation fulcrums 74*a* and are urged with springs 82 (second urging members) that are tension springs. A hook portion 82*a* on a first end side of each spring 82 is fixed to the main body 2, and the hook portion 82*b* on a second end side is hooked on a spring hooking portion 74*b* (an engagement portion) of the corresponding lever 74. The direction in which each lever 74 is urged with the corresponding spring 82 changes according to the position of the lever 74. Each lever 74 is pivoted downwards or upwards. The operation of the levers 74 will be described later.

Figure 6:
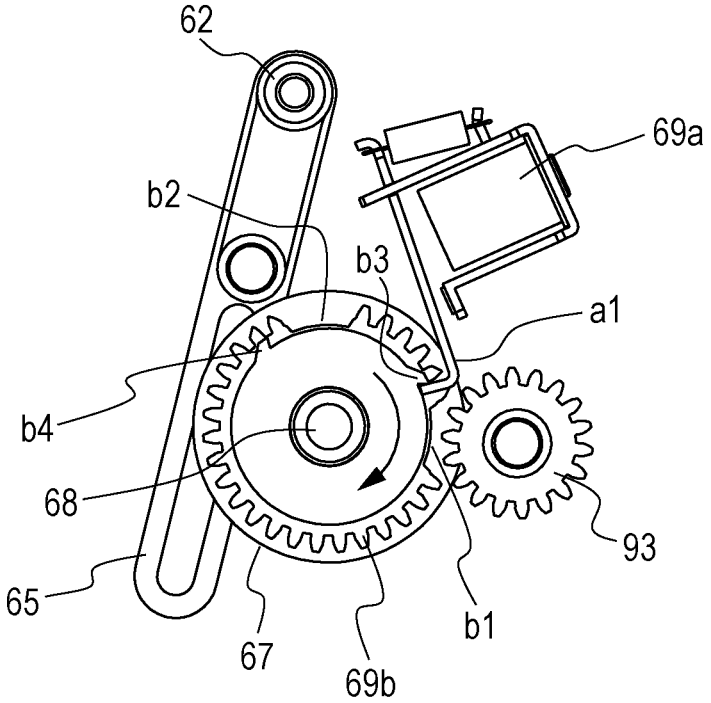
FIG. 6 is a schematic diagram illustrating a configuration of a stopping unit according to the first embodiment.

FIG. 6 is a schematic diagram illustrating a configuration of the cam drive unit 69 serving as a stopping unit. As illustrated in FIG. 6, the partially-toothless gear 69*b* in the cam drive unit 69 has two toothless portions b1 and b2. With the rotation of the partially-toothless gear 69*b*, when the toothless portion b1 or the toothless portion b2 reaches the position of the input gear 93, the transmission of the drive from the input gear 93 to the partially-toothless gear 69*b* is cancelled. In the above, the partially-toothless gear 69*b* is biased by a biasing unit (not shown) to rotate in a direction indicated by the arrow in the figure; however, in a state in which the movable piece a1 of the solenoid 69*a* is engaged with a locking portion b3 or a locking portion b4, the state in which the rotation is stopped is maintained. On the other hand, when the engagement between the movable piece at and the locking portion b3 or the locking portion b4 is released by applying power to the solenoid 69*a*, the partially-toothless gear 69*b* that is rotated in the direction of the arrow in the drawing with the biasing unit (not shown) engages with the input gear 93, and drive is transmitted.

Figure 7:
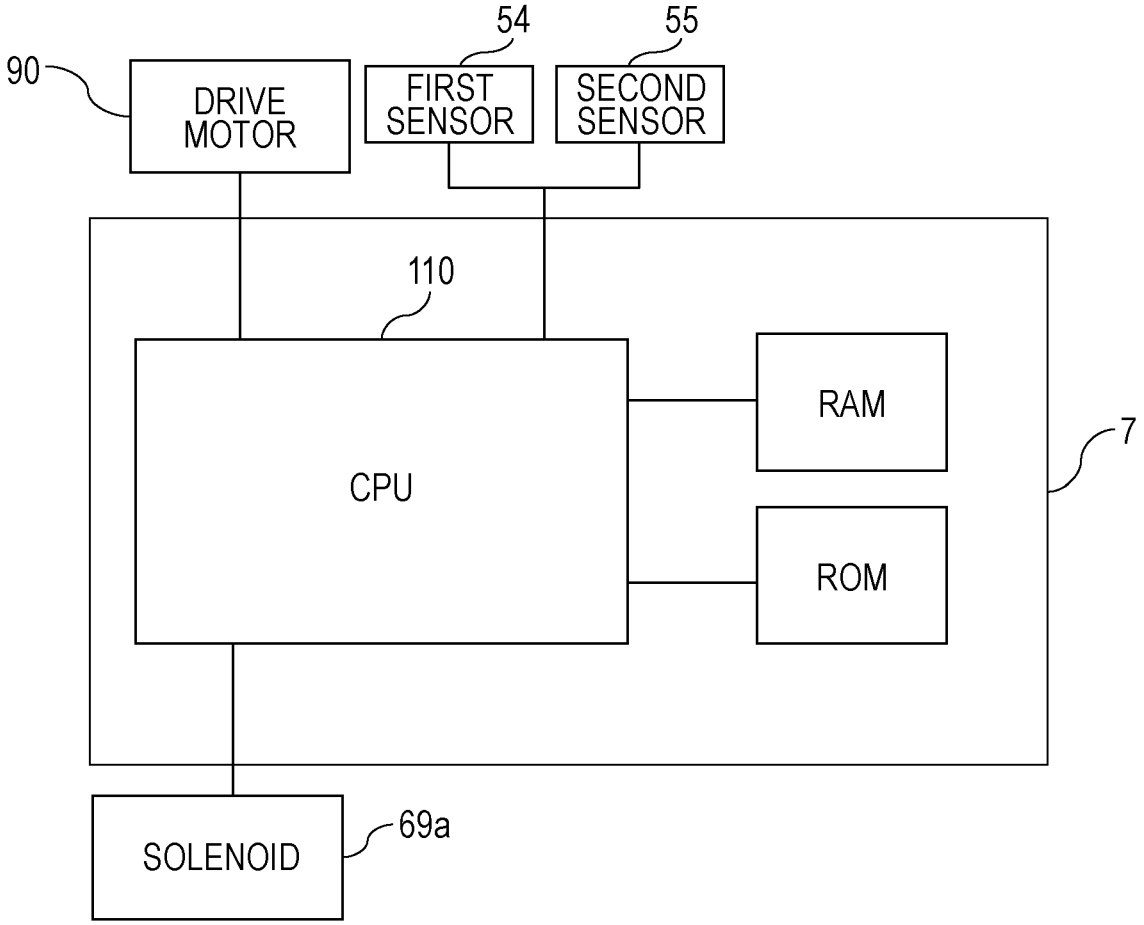
FIG. 7 is a block diagram according to the first embodiment.

A control of the drive according to the present embodiment will be described with reference to the block diagram in FIG. 7. A first end side of the driving roller 62 is connected to a gear 70. Receiving driving force from the drive motor 90 serving as a drive source through the gear 70, the driving roller 62 is rotated. The drive motor 90 rotates only in one direction, and the driving roller 62 rotates only in one direction as well. As illustrated in FIG. 7, a CPU 110 is connected to the drive motor 90, the solenoid. 69*a*, the feed roller 30, the first sensor 54, and the second sensor 55. Furthermore, the CPU 110 is connected to a ROM and a RAM. By using the RAM as a working memory, a program stored in the ROM is executed. In the present embodiment, the CPU 110, the ROM, and the RAM constitute the control unit 7. Furthermore, in the present embodiment, the rotation of the driving roller 62 and the operation of moving the driving roller 62 with the cam drive unit 69 are performed in the reversing unit 6 by having the control unit 7 control the drive motor 90 and the solenoid 69*a*.

The operation of moving the driving roller 62 in the reversing unit 6 will be described next with reference to FIGS. 8A to 8C. In the partially-toothless gear 69*b* of the present embodiment, when the driving roller 62 is positioned in an initial position (a first position), the toothless portion b1 opposes the input gear 93, and when the driving roller 62 is in a retracted position (a second position), the toothless portion b2 opposes the input gear 93. In other words, each time power is applied to the solenoid 69*a* and the cancelling operation is performed, the position of the driving roller 62 can be switched between the initial position and the retracted position.

Figure 8A:
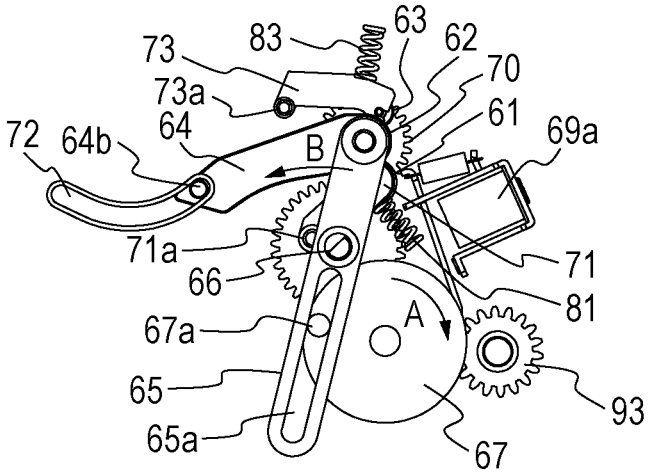
FIGS. 8A to 8C are schematic diagrams illustrating an operation of the reversing unit according to the first embodiment.

FIG. 8A is a schematic diagram of the reversing unit 6 before the operation of moving the driving roller 62 is performed viewed in the axial direction of the driving roller 62. The position of the driving roller 62 in the above case is referred to as the initial position (the first position). The driving roller 62 receiving the driving force from the drive source in the initial position rotates in only one direction.

In the state in FIG. 8A, the toothless portion b1 of the partially-toothless gear 69*b* opposes the input gear 93, and the locking portion b3 engages with the movable piece a1 of the solenoid 69*a* so that the cams 67 do not rotate and the stopped state is maintained. In the above state, when the engagement between the movable piece a1 and the locking portion b3 is released by applying power to the solenoid 69*a*, drive is transmitted from the input gear 93 to the partially-toothless gear 69*b* and the cams 67 rotates in the direction of the arrow A (clockwise) illustrated in the drawing. In the above state, by having the protrusions 67*a* fitted in the guide grooves 65*a* of the driving roller holders 65 (support members) rotate in the direction of the arrow A (clockwise) illustrated in the drawing with the rotation of the cams 67, the driving roller holders 65 rotate about the fulcrums 66 in a direction of the arrow B (counterclockwise) illustrated in the drawing. With the above, the driving roller 62, both ends of which are held by the driving roller holders 65, moves in a direction (the arrow B direction in the drawing) away from the discharge rollers 61 and the reversing rollers 63.

Note that since the reversing guide 64 is supported by both ends of the driving roller 62, and the first end portions 64*a* are held by the driving roller holders 65, the reversing guide 64 move together with the driving roller 62. Furthermore, since the protrusions 64*b* of the reversing guide 64 are fitted in the groove portions 72, the reversing guide 64 moves along the groove portions 72 while changing the angle against the driving roller holders 65. In the above state, the gear 70 connected to the first end side of the driving roller 62 moves together with the driving roller 62 as well. The driving roller 62 while moving receives the driving force from the drive motor 90 serving as a drive source and rotates in one direction.

Figure 8B:
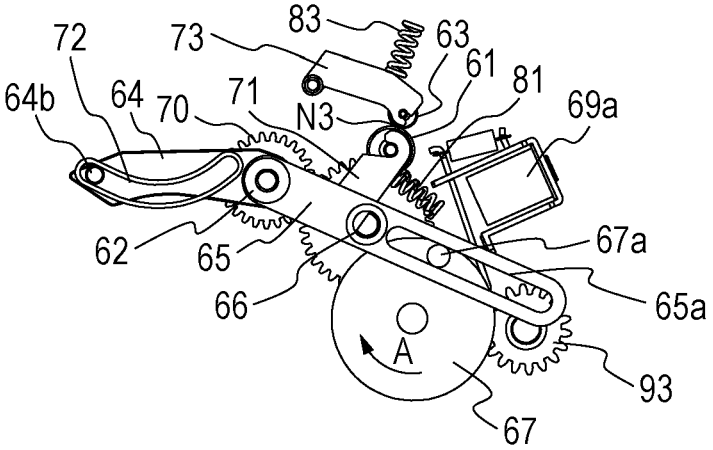

FIG. 8B is a schematic diagram of the reversing unit 6 viewed in the axial direction of the driving roller 62 when the moved amount of the driving roller 62 is the largest after, from the state in FIG. 8A, the driving roller 62 and the reversing guide 64 have been moved with the rotation of the cams 67. In the above state, the driving roller 62 is positioned in the retracted position (the second position) that is a position retracted from the initial position. Furthermore, in the above state, the toothless portion b2 of the partially-toothless gear 69*b* opposes the input gear 93, and the locking portion b4 engages with the movable piece a1 of the solenoid 69*a* so that the cams 67 do not rotate and the stopped state is maintained.

The discharge rollers 61 held by the discharge roller holders 71 are urged towards the driving roller 62 with the springs 81 stretched across between the discharge roller holders 71 and the main body 2. By moving the driving roller 62 from the initial position to the retracted position, the discharge roller holders 71 rotate about the fulcrums 71*a* and the discharge rollers 61 move towards the reversing rollers 63.

Furthermore, the reversing rollers 63 held by the reversing roller holders 73 are urged towards the driving roller 62 with the springs 83 stretched across between the reversing roller holders 73 and the main body 2. By moving the driving roller 62 from the initial position to the retracted position, the reversing roller holders 73 rotate about the fulcrums 73*a* and the reversing rollers 63 move towards the discharge rollers 61. Note that the rotation of the discharge roller holders 71 is restricted at the position in FIG. 8B with a restricting portion (not shown). Accordingly, the reversing rollers 63 move to positions abutting against the discharge rollers 61 that are stopped at the positions in FIG. 8B. With the above, the reversing rollers 63 and the discharge rollers 61 abut against each other and form third nip portions N3 serving as holding portions capable of nipping and holding the conveyed sheet S.

Figure 8C:
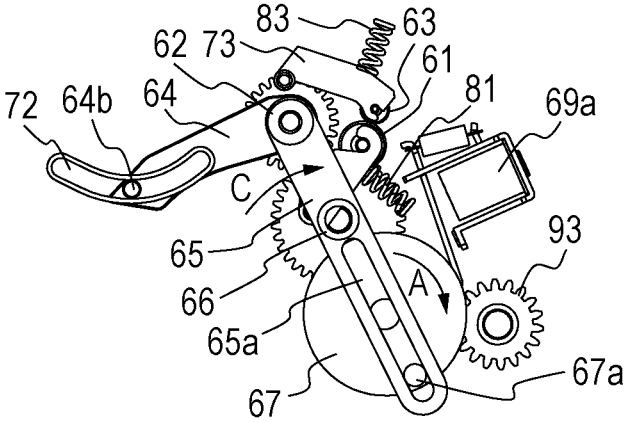

FIG. 8C is a schematic diagram of the reversing unit 6 viewed in the axial direction of the driving roller 62 after, in the state in FIG. 8B, power has been applied once again to the solenoid 69*a* and the engagement between the movable piece a1 and the toothless portion b2 has been released. In the above state, transmission of the drive to the partially-toothless gear 69*b* from the input gear 93 rotates the cams 67 and starts the driving roller 62 to move once again.

As illustrated in FIG. 8C, by having the cams 67 rotate in the direction of the arrow A (clockwise) illustrated. In the drawing, the driving roller holders 65 rotate about the fulcrums 66 in a direction of the arrow C (clockwise) illustrated in the drawing. With the above, the driving roller 62 approaches the discharge rollers 61 and the reversing rollers 63 and moves from the retracted position towards the initial position. The reversing guide 64 moves along the guides of the groove portions 72. When the protrusions 67*a* return to the positions in FIG. 8A, the toothless portion b1 of the partially-toothless gear 69*b* opposes the input gear 93 and the transmission of the drive from the input gear 93 is cancelled. Furthermore, the movable piece a1 of the solenoid 69*a* and the locking portion b3 of the partially-toothless gear 69*b* engage with each other and the rotation of the cams 67 is stopped.

As described above, in the present embodiment, a sequential operation, that is, moving the driving roller 62 from the initial position to the retracted position and moving the driving roller 62 from the retracted position to the initial position, is performed by the cam drive unit 69 while the cams 67 rotate once. Furthermore, since the driving roller 62 moves together with the gear 70, during the sequential operation in which the driving roller 62 moves relative to the discharge rollers 61 and the reversing rollers 63, the driving roller 62 receiving the driving force from the drive motor 90 through the gear 70 continues to rotate in one direction.

Referring next to FIGS. 9A to 9E, the operation of moving the driving roller 62 in the reversing unit 6 when switching from the state in which the sheet S is nipped by the first nip portions N1 to the state in which the sheet S is nipped by the second nip portions N2, and an operation of the levers 74 will be described. In the present embodiment, the driving roller 62 is moved with a switching unit including the driving roller holders 65, the cams 67, the cam shaft 68, and the cam drive unit 69 to switch the nipped state of the sheet S from the first state to the second state.

Figure 9A:
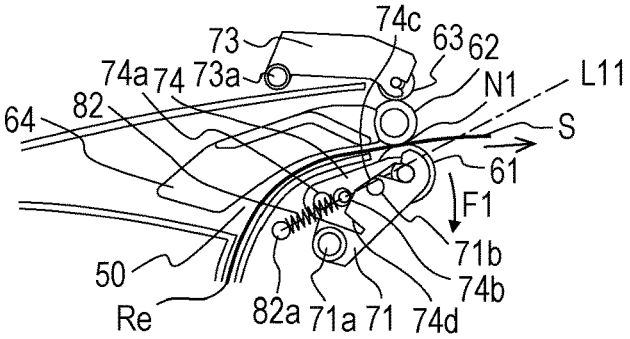
FIGS. 9A to 9E are schematic diagrams illustrating an operation of the reversing unit according to the first embodiment during conveyance of a sheet.

FIG. 9A is a schematic diagram illustrating a state after the sheet S, on which the image has been formed on the first surface, has been conveyed to the first nip portions N1, and immediately before the operation of moving the driving roller 62 is started. In the above state, the driving roller 62 in the initial position (the first position) rotates in one direction. As illustrated in FIG. 9A, in a state in which the sheet S is in contact with the driving roller 62 and the discharge rollers 61, the driving roller 62 starts to move in a direction away from the discharge rollers 61 and the reversing rollers 63 before a rear end Re of the sheet S has been conveyed through the first nip portions N1. Note that as illustrated in FIG. 9A, the rear end Re of the sheet S in the present embodiment refers to a rearmost end portion of the sheet S in the first direction in which the sheet S is conveyed.

When the driving roller 62 is at the initial position, each lever 74 is held at a position illustrated in FIG. 9A with the corresponding spring 82 having the corresponding hook portion 82*a* fixed to the main body 2. Note that a second end portion of the spring 82 on the side opposite to the hook portion 82*a* is fixed to the spring hooking portion 74*b* provided in the lever 74. In the above state, since a line segment L11 connecting the hook portion 82*a* and the spring hooking portion 74*b* to each other is situated below the rotation fulcrum 74*a* that is a rotation center of the lever 74, the lever 74 is urged to rotate in an arrow F1 direction illustrated in the drawing.

By having a contact surface 74*c* of each lever 74 that has been urged to rotate in the arrow F1 direction illustrated in the drawing is abutted against a protrusion 71*b* provided in the corresponding discharge roller holder 71, the lever 74 is held at the position illustrated in FIG. 9A while the rotation thereof is restricted. In the above state, the sheet S is nipped by the first nip portions N1 formed between the driving roller 62 and the discharge rollers 61 and is conveyed in the first direction along the first conveyance path 50. In such a state, since the levers 74 are held at positions retracted from the first conveyance path 50, the levers 74 do not come in contact with the sheet S conveyed in the first direction.

Figure 9B:
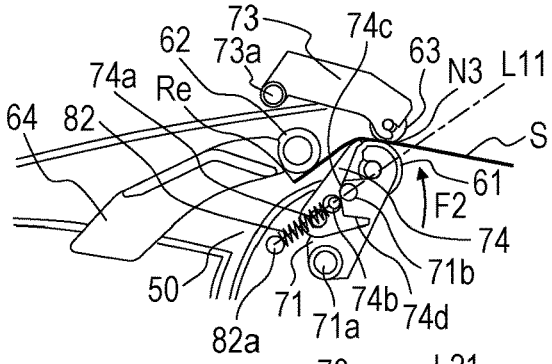

By actuating the solenoid 69*a* at a timing at which the sheet S has reached a predetermined position, the driving roller 62 starts to move from the initial position towards the retracted position. When the driving roller 62 moves, as illustrated in FIG. 8B, the discharge roller holders 71 urged by the springs 81 turn in the counterclockwise direction about the fulcrums 71*a*. Then, as illustrated in FIG. 9B, the levers 74 pushed by the protrusions 71*b* of the discharge roller holders 71 are rotated in the arrow F2 direction illustrated in the drawing. Then, the line segments L11 connecting the spring hooking portions 74*b* of the levers 74 and the hook portions 82*a* move above the rotation fulcrums 74*a*, which is on a side opposite to the side on which the line segments L11 are situated in FIG. 9A. As a result, the levers 74 rotating in the arrow F2 direction illustrated in the drawing with the urging force of the springs 82 protrude into the first conveyance path 50 and comes into contact with the sheet S from a discharge roller 61 side.

Figure 9C:
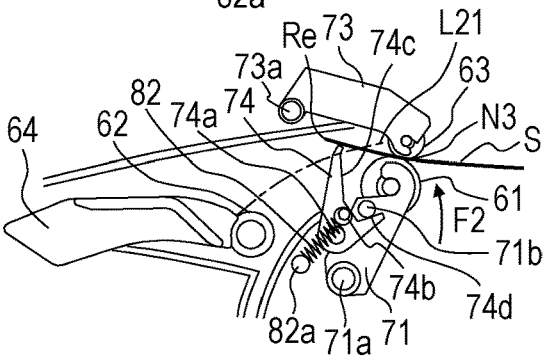

FIG. 9C is a schematic diagram illustrating a state of the sheet S when the driving roller 62 has moved to the retracted position (the second position) in which the moved amount of the driving roller 62 is the largest. The driving roller 62 moves upstream with respect to the rear end of the sheet 5, the sheet S being in contact with the driving roller 62 and the discharge rollers 61 in the first nip portions N1, in the conveying direction of the sheet S in the first nip portions N1.

As illustrated in FIG. 9C, when the driving roller 62 moves from the initial position to the retracted position, the first nip portions N1 formed between the driving roller 62 and the discharge rollers 61 are eliminated and the conveyance of the sheet S is temporarily stopped. In the above state, the discharge rollers 61 and the reversing rollers 63 form the third nip portions N3, and the sheet S conveyed in the first direction in the first nip portions N1 is nipped by the third nip portions N3 and is held while in a state in which the conveyance of the sheet S is stopped. Since the sheet S is nipped with the third nip portions N3, the sheet S does not fall from the reversing unit 6 when the driving roller 62 is moved, and the sheet S is held by the discharge rollers 61 and the reversing rollers 63.

Furthermore, in a state illustrated in FIG. 9C, the levers 74 are held in a state in which the rotation in the arrow F2 direction illustrated in the drawing is restricted by having contact surfaces 74*d* that are different from the contact surfaces 74*c* that have been abutted against the protrusions 71*b* in FIG. 9A be abutted against the protrusions 71*b*. In so doing, the levers 74 which have been restricted from rotating are held at positions that lift the vicinity of the rear end Re of the sheet S towards the reversing rollers 63 front the discharge roller 61 side. By being lifted by the levers 74, the rear end Re of the sheet S is lifted above a moving trajectory L21 of the outer peripheral surface of the driving roller 62.

Figure 9D:
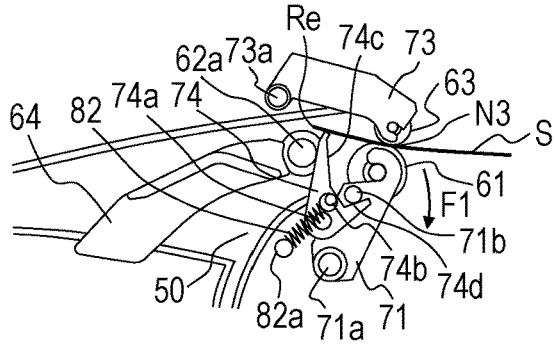

FIG. 9D is a schematic diagram illustrating a state of the sheet S when the solenoid 69*a* has been actuated once again and the driving roller 62 is in the course of moving from the retracted position to the initial position. The driving roller 62 moves from the retracted position to the initial position by approaching the discharge rollers 61 and the reversing rollers 63 from the undersurface side of the sheet S nipped by the third nip portions N3, in other words, from the side on which the surface of the sheet S against which the discharge roller had been in contact with is situated.

When the driving roller 62 moves towards the initial position, as illustrated in FIG. 9D, a shaft portion 62*a* of the driving roller 62 abuts against each lever 74. Subsequently, when the driving roller 62 further moves towards the initial position, the levers 74 are pushed by the shaft portion 62*a* of the driving roller 62 and are rotated in the arrow F1 direction illustrated in the drawing. As illustrated in FIG. 4, a diameter of the shaft portion 62*a* of the driving roller 62 is smaller than a diameter of each rubber roller portion 62*b* in contact with the sheet S. Accordingly, when the levers 74 and the shaft portion 62*a* are abutted against each other, a portion of each rubber roller portion 62*b* is, in the first direction, positioned downstream of the corresponding lever 74 lifting the rear end Re of the sheet S.

Accordingly, the driving roller 62 enters a portion on the undersurface side (the lower side in the gravitational direction) of the sheet S by the time the state in which the rear end Re of the sheet S is lifted by the levers 74 is cancelled with the rotation of the levers 74 in the arrow F1 direction illustrated in the drawing. In other words, the operation of the levers 74 suppresses the driving roller 62 from impinging against the rear end Re of the sheet S or from returning to an upper surface side of the sheet S once again, while the driving roller 62 moves from the retracted position to the initial position.

Figure 9E:
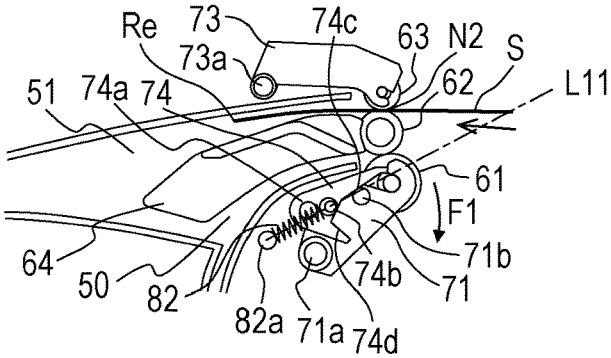

FIG. 9E is a schematic diagram illustrating a state of the sheet S when the driving roller 62 has moved to the initial position. As illustrated in FIG. 9E, when the operation of moving the driving roller 62 to move the driving roller 62 to the initial position from the undersurface side of the sheet S is completed, the sheet S that has been held by the discharge rollers 61 and the reversing rollers 63 is nipped by the driving roller 62 and the reversing rollers 63. In other words, the sheet S that has been conveyed in the first direction in the first nip portions N1 is nipped by the second nip portions N2 with the movement of the driving roller 62, and is conveyed in the second conveyance path 51 in the second direction, which is a direction opposite to the direction in FIG. 9A, in the second nip portions N2 with the rotation of the driving roller 62.

Note that in so doing, after the levers 74 are urged to rotate in the arrow F1 direction illustrated in the drawing so that the rotation fulcrums 74*a* are, owing to the rotation, moved to a position below the line segment L11, the levers 74 are abutted against the protrusions 71*b* and are held at the positions illustrated in FIG. 9E. The positions at which the levers 74 are held in FIG. 9D are the same as the positions in FIG. 9A, and the levers 74 are held at the retracted position with respect to the first conveyance path 50; accordingly, the levers 74 do not, at the second nip portions N2, come into contact with the sheet S conveyed in the second direction.

Note that in the present embodiment, the solenoid 69*a* has been operated twice at predetermined timings to perform the operation illustrated from FIGS. 9A to 9E; however, not limited to the above control, after power is applied to the solenoid 69*a*, the power may be applied to the solenoid 69*a* until the locking portion of the partially-toothless gear 69*b* passes the locked position and, then after, the application of power may be stopped such that the cams 67 rotate once without any stop in between. In the present embodiment, a configuration that temporally stops the movement of the driving roller 62 with the stopping unit is employed; however, not limited to such a configuration, a configuration that does not temporally stop the movement of the driving roller 62 can also obtain the effect of the present disclosure.

Figure 10A:
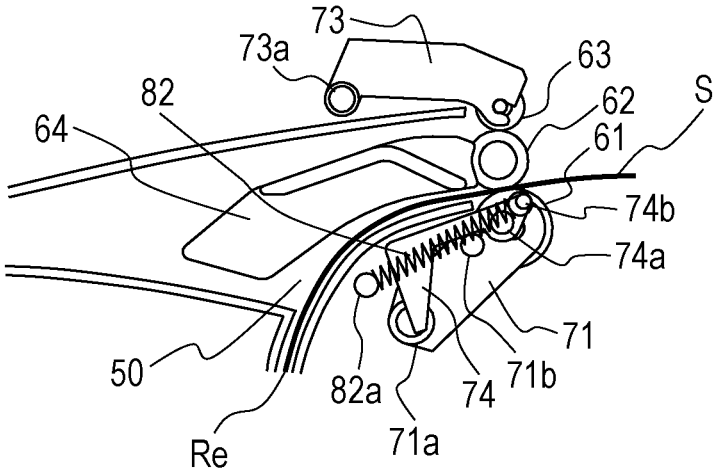
FIGS. 10A and 10B are schematic diagrams illustrating an operation of the reversing unit according to a modification example of the first embodiment during conveyance of a sheet.
Figure 10B:
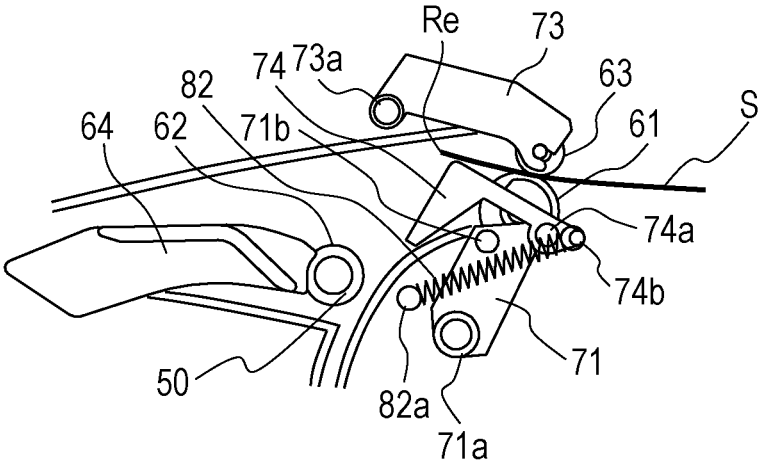

As described above, in the present embodiment, the following effects can be obtained by providing the levers 74 serving as regulating members, which regulate the position of the sheet S by lifting the rear end Re of the sheet S. In other words, by having the levers 74 lift the rear end Re of the sheet S nipped by the third nip portions N3, the driving roller 62 that has moved from the initial position to the retracted position can be moved towards the initial position from the undersurface side of the sheet S in a stable manner. With the above, the driving roller 62 can be prevented from impinging against the rear end Re of the sheet S or from returning to an upper surface side of the sheet S once again while the driving roller 62 moves from the retracted position to the initial position, and a decrease in the sheet conveying performance can be suppressed, Note that the configuration of the levers 74 is not limited to the configuration described above. For example, as in a modification example of the present embodiment illustrated in FIGS. 10A and 10B, the levers 74 may have rotation fulcrums 74*a* on the downstream side. In such a case, the levers 74 moves between a position illustrated in FIG. 10A and a position illustrated in FIG. 10B while the driving roller 62 is in motion, and the levers 74 can function in a similar manner to the levers 74 in the present embodiment. Note that by being regulated by a stopper (not shown) at the position in FIG. 10B, each lever 74 of the modification example is held at a position that lift the rear end Re of the sheet S.

Referring next to FIGS. 11A to 11D, a conveyance operation of the sheet S during double-side printing with the image forming apparatus 1 including the present embodiment will be described.

Figure 11A:
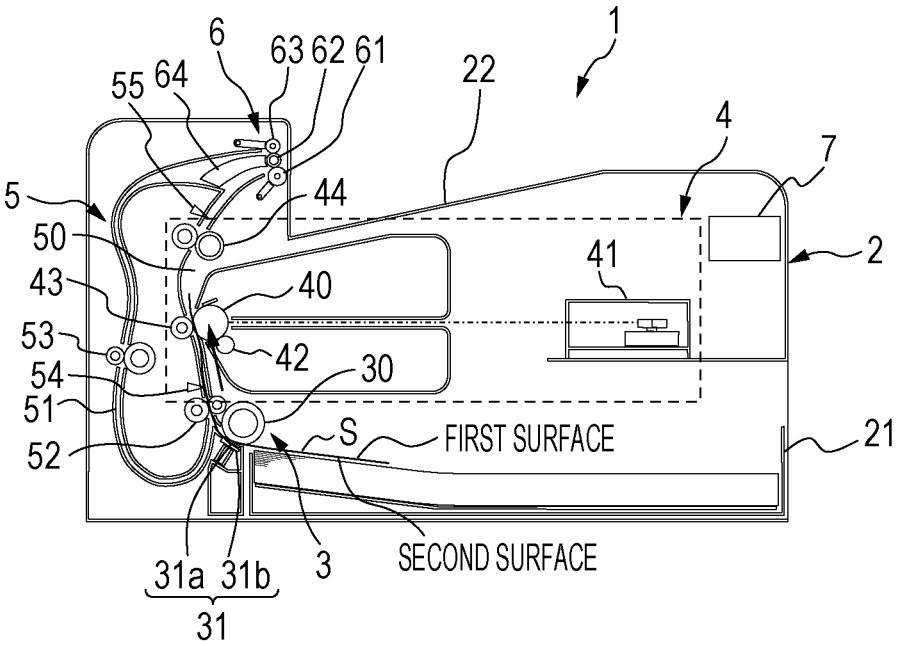
FIGS. 11A to 11D are schematic cross-sectional views illustrating a sheet conveying operation according to the first embodiment when an image is formed on each side of the sheet.

FIG. 11A is a schematic cross-sectional view illustrating a state after the sheet S accommodated in the sheet feeding cassette 21 has been fed with the feed roller 30. As illustrated in FIG. 11A, the sheets S that have been taken out from the sheet feeding cassette 21 with the feed roller 30 are separated into single sheets in the separating unit 31. The sheet S is then fed to the first conveyance path 50 and is conveyed to the image forming unit 4 with the first pair of conveyance rollers 52. Subsequently, the front end of the sheet S is detected by the first sensor 54, and an image is formed on a first surface of the sheet S in the image forming unit 4 at a timing based on the detection information.

Figure 11B:
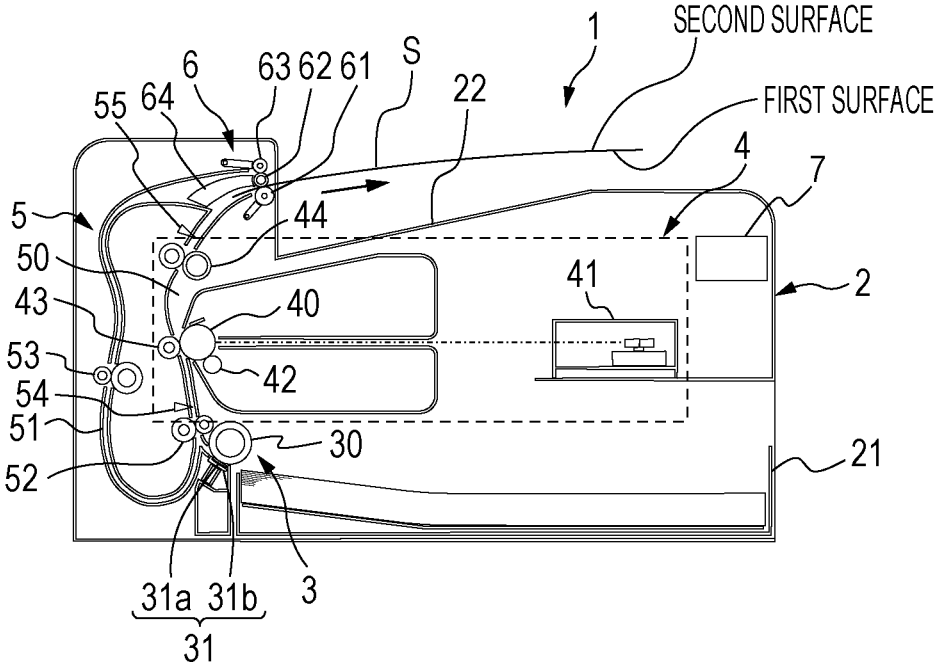

FIG. 11B is a schematic cross-sectional view illustrating a state after the sheet S, on which the image has been formed on the first surface, has been conveyed to the reversing unit 6, and illustrates a state immediately before the operation of moving the driving roller 62 is started. After the toner image transferred on the first surface of the sheet S is fixed in the fixing unit 44, the sheet S is nipped by the first nip portions N1 formed between the driving roller 62 and the discharge rollers 61 and is conveyed in the first direction (the direction illustrated by the solid line arrow in the drawing). In the above, the sheet S is conveyed in the first direction while in a state (a first state) in which the first surface of the sheet S is in contact with the discharge rollers 61, and a second surface is in contact with the driving roller 62.

The rear end of the sheet 5, the sheet S being in contact with the driving roller 62 and the discharge rollers 61 at the first nip portions N1, is detected by the second sensor 55. Furthermore, based on the detection information, the driving roller 62 starts to move before the rear end of the sheet S is conveyed through the first nip portions N1. In other words, in the present embodiment, the driving roller 62 starts to move before the rear end of the sheet S has been completely passed through the first nip portions N1. The sheet S that has been nipped by the first nip portions N1 and that has been conveyed in the first direction is, with the moving of the driving roller 62, nipped by the second nip portions N2. The moving of the driving roller 62 is started by the control unit 7 controlling the solenoid 69*a* based on the detection information from the second sensor 55. Note that the control unit 7 may control the start of the movement of the driving roller 62 based on the detection information of the front end of the sheet S detected with second sensor 55. The operation of moving the driving roller 62 when switching from the state in which the sheet S is nipped by the first nip portions N1 to the state in which the sheet S is nipped by the second nip portions N2 is as described above while referring to FIGS. 10A and 10B.

Figure 11C:
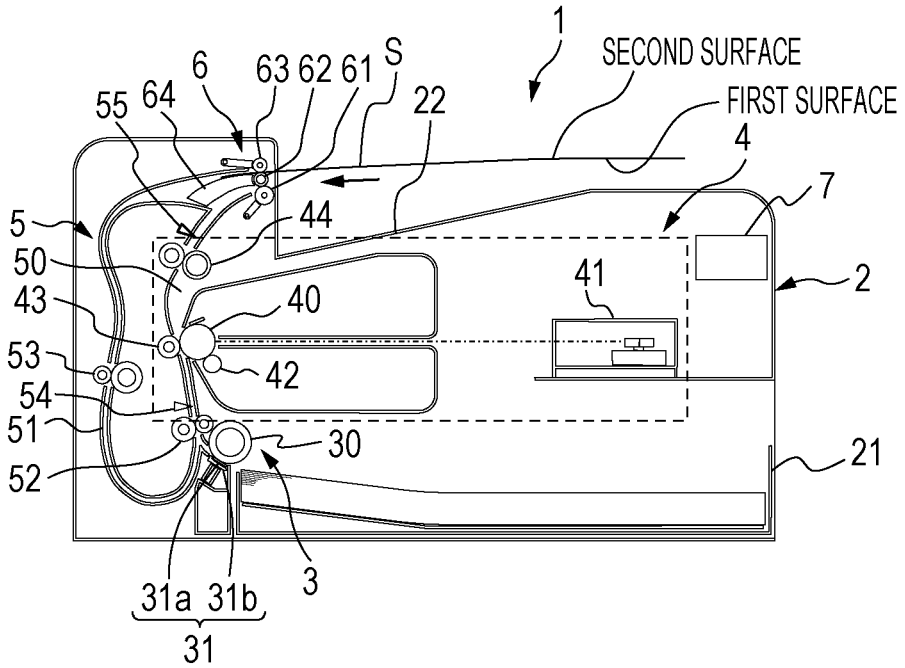

FIG. 11C is a schematic cross-sectional view illustrating a state in which the sheet S is nipped in the second nip portions N2 after the operation of moving the driving roller 62 has been performed. When the sheet S that has been nipped by the first nip portions N1 is nipped by the second nip portions N2 owing to the movement of the driving roller 62, the sheet S is conveyed at the second nip portions N2 in the second direction (the direction illustrated by the solid line arrow in the drawing) that is different from the first direction. In the above, the sheet S is conveyed in the second direction while in a state (a second state) in which the second surface of the sheet S is in contact with the reversing rollers 63, and the first surface is in contact with the driving roller 62. With the above, the sheet S that had been conveyed in the first direction in the first nip portions N1 is conveyed in the second direction in the second nip portions N2 and is conveyed to the second conveyance path 51.

Figure 11D:
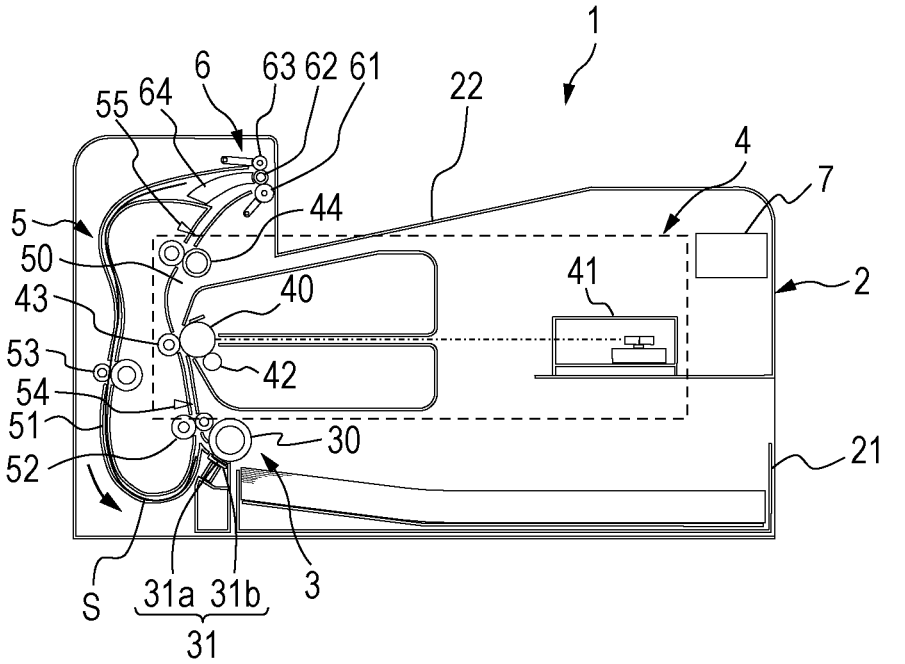

FIG. 11D is a schematic cross-sectional view illustrating a state immediately before the sheet S that has been conveyed in the second direction is conveyed once again to the image forming unit 4. As illustrated in FIG. 11D, the sheet S that has been conveyed to the second conveyance path 51 is conveyed to the first conveyance path 50 with the second pair of conveyance rollers 53. Subsequently; in the image forming unit 4, a toner image is transferred to the second surface of the sheet S with the transfer roller 43. Furthermore, by fixing the toner image formed on the second surface of the sheet S with the fixing unit 44, an image is formed on each of the first surface and the second surface of the sheet S. The sheet S, in which formation of an image has been completed on both surfaces, is conveyed once again to the first nip portions N1 of the reversing unit 6, and is conveyed in the first direction in the first nip portions N1. Subsequently, this time, the driving roller 62 is not moved and the sheet S is discharged through the first nip portions N1 to the sheet discharge tray 22. Formation of an image on both surfaces of the sheet S according to the present embodiment is completed in the above manner.

As described above, in the present embodiment, the driving roller 62 is moved with a switching unit including the driving roller holders 65, the cams 67, the cam shaft 68, and the cam drive unit 69 to switch the nipped state of the sheet S from the first state to the second state.

As described above, in the present embodiment, the switching unit moves the driving roller 62 before the rear end Re of the sheet S, which is conveyed in the first direction in the first nip portions N1, has been conveyed through the first nip portions. With the above, the nip portion in which the sheet S is nipped can be switched from the first nip portions N1 to the second nip portions N2 to change the conveying direction of the sheet S; accordingly, the sheet S can be reversed.

Moreover, in the present embodiment, by moving the driving roller 62 from the initial position to the retracted position, the conveyed sheet S is held in the third nip portions N3. In other words, the nip portion of the sheet S can be switched from the first nip portions N1 to the second nip portions N2 with the movement of the driving roller 62 without the sheet S being completely discharged from the reversing unit 6. With the above, the conveying direction of the sheet S can be changed without discharging the sheet S from the reversing unit 6.

As described in the description of the related art, as a method of changing the conveying direction of the sheet, one can conceive a method in which, after completely discharging a sheet through a first nip portion in a group of reversing rollers that includes three continuous rollers, conveying the sheet to the second nip portion. In such a configuration, the reversing of the sheet can be performed by a switchback portion provided to temporarily accommodate the sheet at a portion downstream of the group of reversing rollers in the sheet conveying direction. In other words, the sheet that has been completely discharged through the first nip portions is temporarily accommodated on the switchback portion and, subsequently, the sheet is conveyed to the second nip portion from the switchback portion to change the conveying direction of the sheet. However, with such a configuration, a discharge unit for discharging the sheet from inside the image forming apparatus needs to be provided at a position different from where the reversing unit that performs the sheet reversing is positioned, which leads to increase in the size of the apparatus.

Conversely, in the configuration of the present embodiment, the sheet S is not completely discharged through the first nip portions N1 of the reversing unit 6, and by moving the driving roller 62, the nip portion in which the sheet S is nipped is switched from the first nip portions N1 to the second nip portions N2. Accordingly, in the configuration of the present embodiment, a switchback portion that temporarily accommodates the sheet S does not need to be provided, in other words, in the configuration of the present embodiment, the reversing unit 6 can perform reversing of the sheet S, and discharging of the sheet S from the main body 2 to the sheet discharge tray 22. With the above, the conveying direction of the sheet S can be changed without increasing the size of the apparatus.

Furthermore, in the present embodiment, the driving roller 62 rotates in only one direction when the sheet S is conveyed. With the above, in the reversing unit 6 of the present embodiment, the rotation direction of the driving roller 62 does not have to be switched to reverse rotation when the sheet S is conveyed in the second direction, and a mechanism to switch the rotation direction of the driving roller 62 is not needed.

Referring next to FIGS. 12A to 12H, a conveyance operation of the sheet S in a case in which an image is formed on each of the surfaces of two or more sheets in a continuous manner will be described. Note that the first sheet that is fed from the sheet feeding cassette 21 is referred to as a first sheet S1 (a first sheet), and the sheet succeeding the first sheet S1, which is the second sheet, is referred to as a second sheet S2 (a second sheet). Furthermore, same applies hereinafter, and the third sheet is referred to as a third sheet S3, and the fourth sheet is referred to as a fourth sheet S4.

Figure 12A:
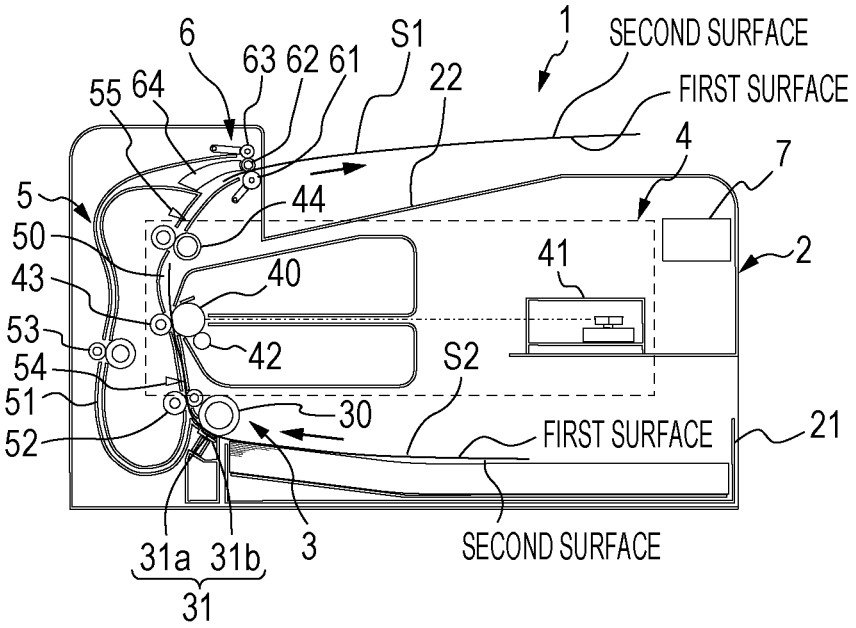
FIGS. 12A to 12H are schematic cross-sectional views illustrating a sheet conveying operation according to the first embodiment when an image is continuously formed on each side of a plurality of sheets.

FIG. 12A is a schematic cross-sectional view illustrating a state after the formation of an image on the first surface of the first sheet S1 has been completed, and immediately before the first sheet S1 is moved from the first nip portions N1 to the second nip portions N2 with the operation of moving the driving roller 62. In a case in which an image is formed on two or more sheets in a continuous manner, the operation of feeding the second sheet S2 is started after a predetermined interval is formed with the rear end of the first sheet S1. In the present embodiment, when the first sheet S1 moves from the first nip portions N1 to the second nip portions N2 with the operation of moving the driving roller 62, the second sheet S2 is already fed with the feed roller 30, and transfer of a toner image to the first surface is started in the image forming unit 4.

Figure 12B:
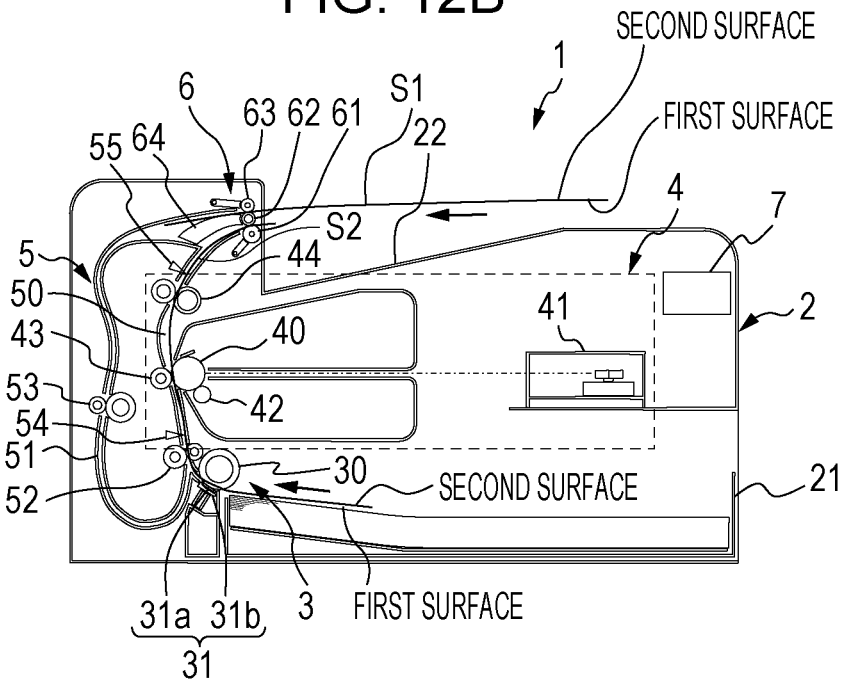

FIG. 12B is a schematic cross-sectional view illustrating a state in which the first sheet S1 is nipped by the second nip portions N2 with the movement of the driving roller 62 and is conveyed in the second direction at the second nip portions N2. When the first sheet S1 that has been nipped in the first nip portions N1 is nipped by the second nip portions N2 with the movement of the driving roller 62, the first sheet S1 is, at the second nip portions N2, conveyed in the second direction towards the second conveyance path 51. As described above, since the first sheet S1 that has been nipped in the first nip portions N1 is nipped by the second nip portions N2 with the movement of the driving roller 62, the first nip portions N1 to which the first sheet S1 has been conveyed can be emptied.

With the above, while the first sheet S1 is conveyed in the second direction, the second sheet S2 that is a succeeding sheet of the first sheet S1 can be conveyed to the first nip portions N1 of the reversing unit 6. The second sheet S2 is conveyed in the first direction in the first nip portions N1. In other words, the first sheet S1 and the second sheet S2 are conveyed in the reversing unit 6 while passing by each other (hereinafter, referred to as a passing-by conveyance). In the above, the second surface of the first sheet S1 comes in contact with the reversing rollers 63, and the first surface of the first sheet S1 comes in contact with the driving roller 62. Furthermore, the second surface of the second sheet S2 comes in contact with the driving roller 62, and the first surface of the second sheet S2 comes in contact with the discharge rollers 61.

Figure 12C:
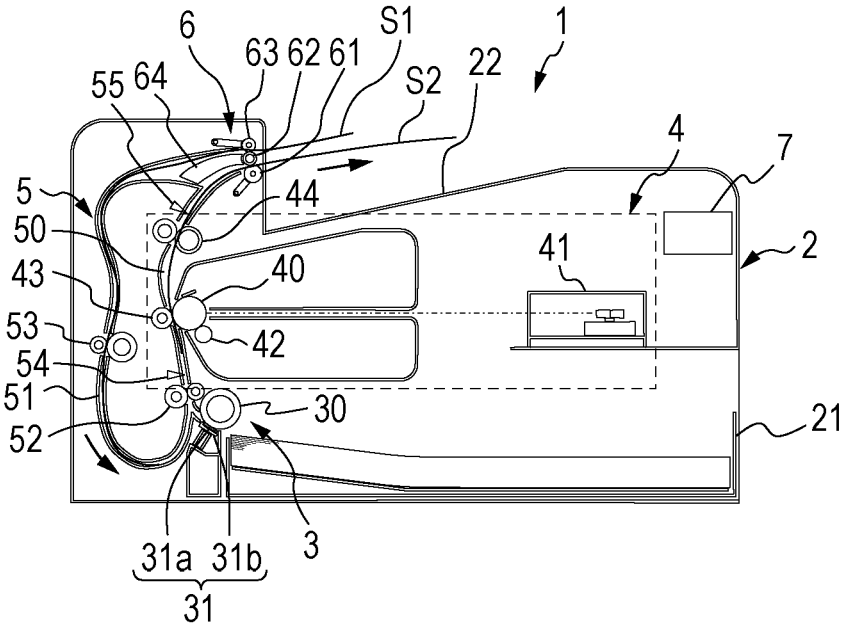

FIG. 12C is a schematic cross-sectional view illustrating a state before the first sheet S1 is conveyed once again to the first conveyance path 50 from the second conveyance path 51. In the state illustrated in FIG. 12C, the second sheet S2 is conveyed in the first direction in the first nip portions N1, and the rear end of the second sheet S2 has already passed the position where the first conveyance path 50 and the second conveyance path S1 meet each other. Accordingly, the first sheet S1 is conveyed once again to the first conveyance path 50 while a set interval is formed with the second sheet S2 without the front end of the first sheet S1 that is a preceding sheet impinging on the rear end of the second sheet S2 that is a succeeding sheet.

Figure 12D:
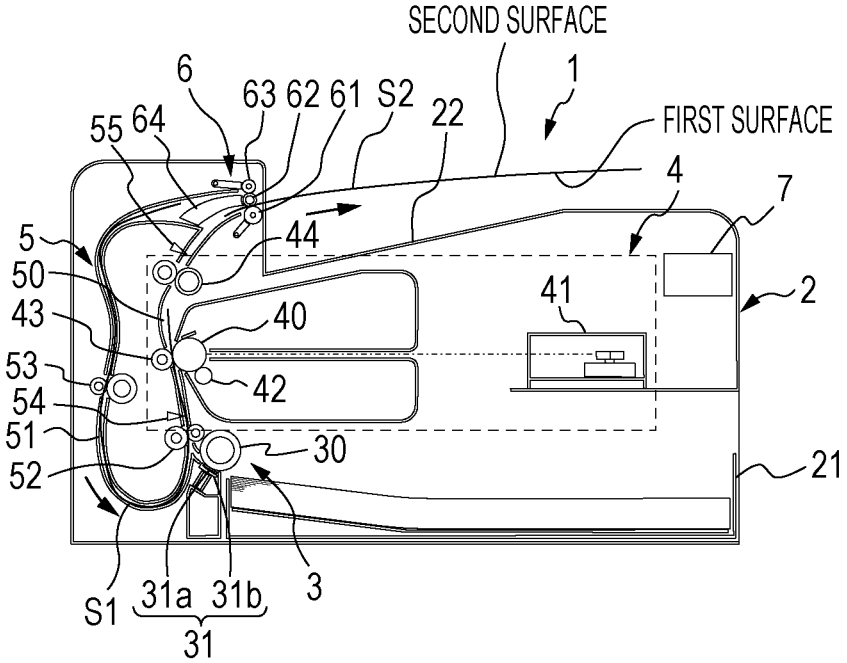

FIG. 12D is a schematic cross-sectional view illustrating a state immediately before the second sheet S2, in which formation of an image on the first surface thereof has been completed, is moved from the first nip portions N1 to the second nip portions N2 with the movement of the driving roller 62. In the above, a toner image is, in the image forming unit 4, transferred to the second surface of the first sheet S1 that has been conveyed once again to the first conveyance path 50 while a set interval is formed with the rear end of the second sheet S2.

Figure 12E:
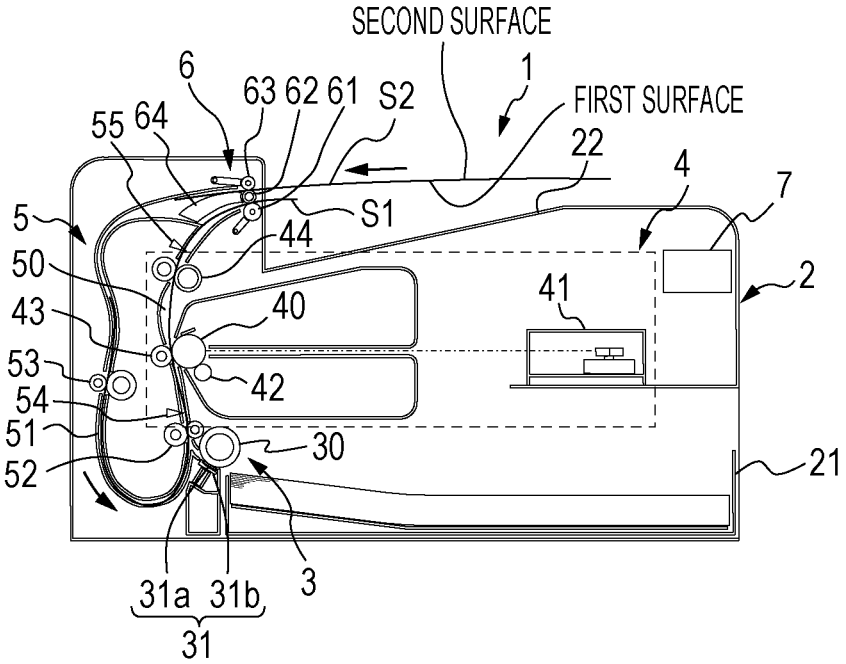

FIG. 12E is a schematic cross-sectional view illustrating a state in which the second sheet S2 is nipped by the second nip portions N2 with the movement of the driving roller 62 and is conveyed in the second direction at the second nip portions N2. In the above, the second sheet S2 that has been nipped in the first nip portions N1 is, at the second nip portions N2, conveyed towards the second conveyance path 51 in the second direction. In the case of the second sheet S2 as well, similar to the first sheet S1, the first nip portions N1 can be emptied by having the second sheet S2 that has been nipped in the first nip portions N1 be nipped by the second nip portions N2 with the movement of the driving roller 62.

With the above, the first sheet S1 on which an image has been formed on the second surface in the image forming unit 4 can be conveyed in the first direction in the first nip portions N1 while the second sheet S2 is conveyed in the second direction. In the above, the second sheet S2 is conveyed in the second direction in the second nip portions N2, and the first sheet S1, on which an image has been formed on each of the surfaces, is conveyed in the first direction in the first nip portions N1. In other words, the passing-by conveyance of the first sheet S1 and the second sheet S2 is performed again in the reversing unit 6. In the above, the second surface of the second sheet S2 comes in contact with the reversing rollers 63, and the first surface of the second sheet S2 comes in contact with the driving roller 62. Furthermore, the first surface of the first sheet S1 comes in contact with the driving roller 62, and the second surface of the first sheet S1 comes in contact with the discharge rollers 61.

In the present embodiment, when the conveying direction of the first sheet S1 is changed, the passing-by conveyance of the first sheet S1 and the second sheet S2 is performed in the reversing unit 6 in the above manner by conveying the second sheet S2 to the reversing unit 6. Moreover, when the second sheet S2 is conveyed in the second direction in the second nip portions N2, by conveying the first sheet S1 on which an image is formed on both the first surface and the second surface to the reversing unit 6, the passing-by conveyance of the second sheet S2 and the first sheet S1 can be performed once again.

Figure 12F:
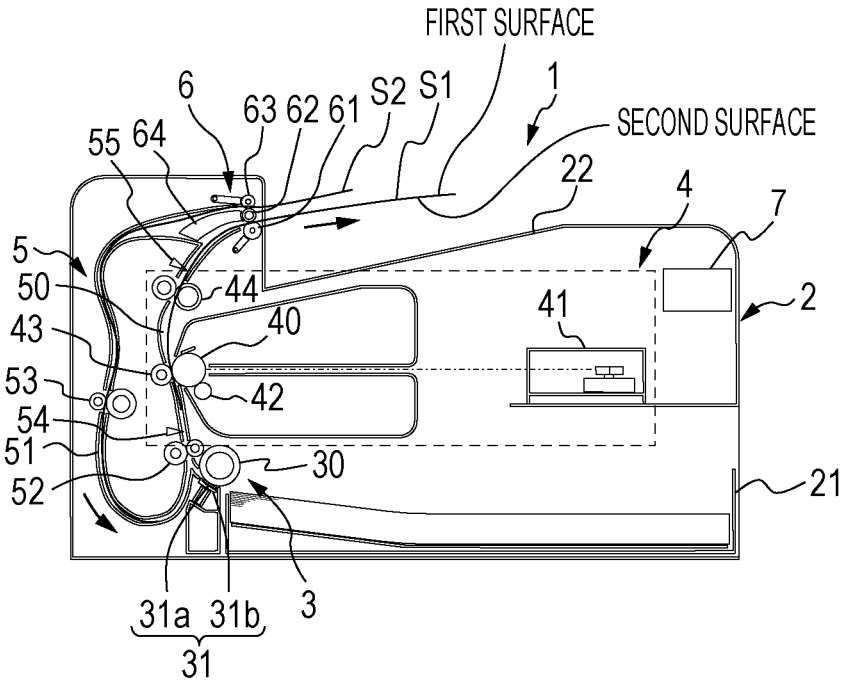

FIG. 12F is a schematic cross-sectional view illustrating a state before the second sheet S2 is conveyed once again from the second conveyance path 51 to the first conveyance path 50. In the above state, the first sheet S1 on which an image has been formed on both surfaces has been conveyed in the first direction in the first nip portions N1, and the rear end of the first sheet S1 has already passed a junction between the first conveyance path 50 and the second conveyance path 51. Accordingly, when the second sheet S2 is conveyed once again to the first conveyance path 50, the rear end of the first sheet S1 and the front end of the second sheet S2 do not impinge on each other. The second sheet S2 is conveyed once again to the first conveyance path 50 while a set interval is formed with the first sheet S1.

Figure 12G:
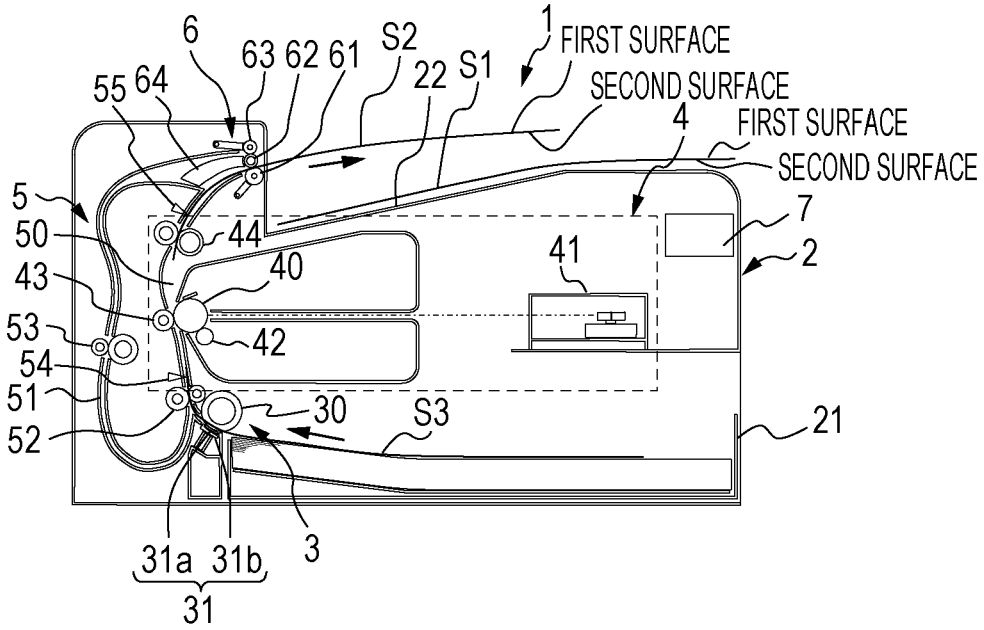

FIG. 12G is a schematic cross-sectional view illustrating a state after the first sheet S1 on which an image is formed on both surfaces is discharged to the sheet discharge tray 22 through the first nip portions N1. The first sheet S1 on which an image is formed on both surfaces is discharged to the sheet discharge tray 22 through the first nip portions N1 and is stacked on the sheet discharge tray 22. In the above, the switching unit does not move the driving roller 62. Furthermore, the second sheet S2 that has been conveyed once again to the first conveyance path 50 and on which an image is formed on both of the first surface and the second surface is, similar to the first sheet S1, conveyed in the first direction in the first nip portions N1. Note that in so doing, the third sheet S3 is fed towards the image forming unit 4 from the sheet feeding cassette 21 while a predetermined interval is formed with the rear end of the second sheet S2.

Figure 12H:
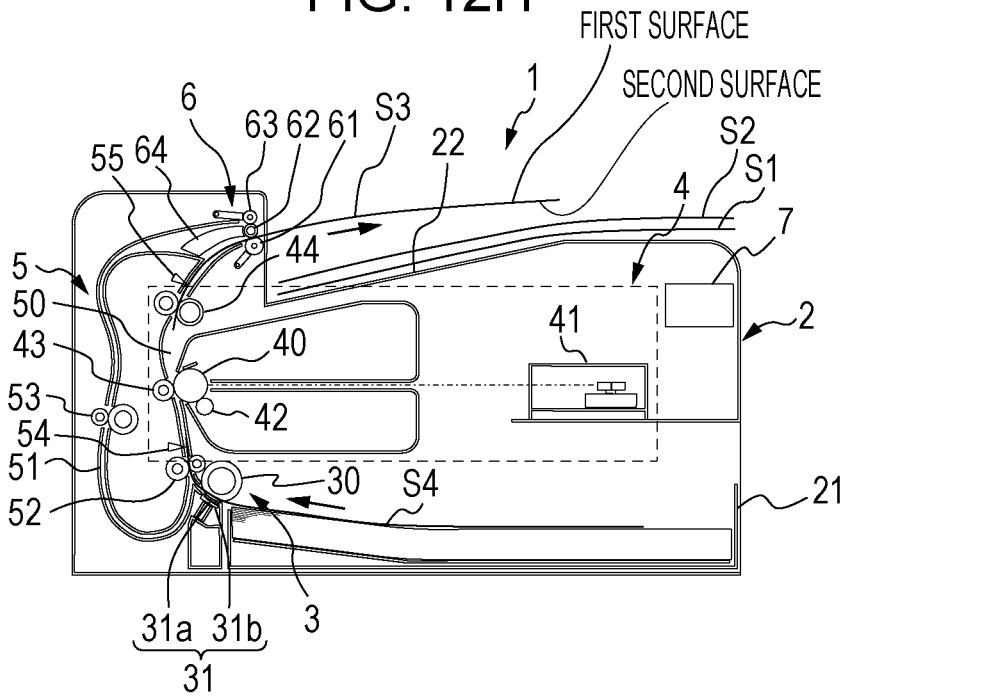

FIG. 12H is a schematic cross-sectional view illustrating a state after the second sheet S2 on which an image is formed on both surfaces is discharged to the sheet discharge tray 22 through the first nip portions N1. Similar to the first sheet S1, the second sheet S2 on which an image has been formed on both sides is discharged to the sheet discharge tray 22 through the first nip portions N1. In the above, the switching unit does not move the driving roller 62. With the above, the first sheet S1 and the second sheet S2 are stacked on the sheet discharge tray 22. Furthermore, the third sheet S3 on which an image has been formed on the first surface is conveyed in the first direction in the first nip portions N1 of the reversing unit 6. Furthermore, in doing so, the fourth sheet S4 is fed towards the image forming unit 4 from the sheet feeding cassette 21 while a predetermined interval is formed with the rear end of the third sheet S3.

Similar to the case of the first sheet S1 and the second sheet S2, the sequential movements in FIGS. 12A to 12H are performed on the third sheet S3 and the fourth sheet S4. Furthermore, the third sheet S3 and the fourth sheet S4, on which an image has been formed on both surfaces, are discharged and stacked on the sheet discharge tray 22. In the present embodiment, by performing the operation of moving the driving roller 62 in the reversing unit 6, the passing-by conveyance can be efficiently performed on a plurality of sheets S.

Figure 13A:
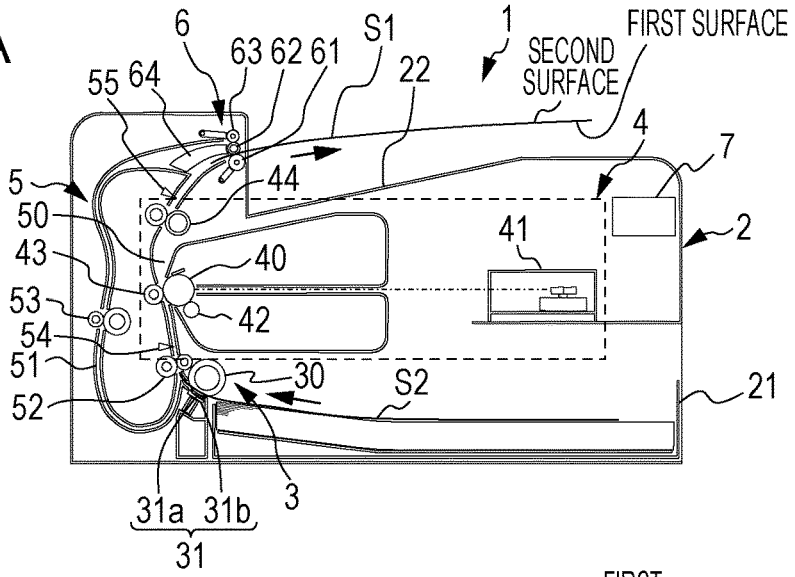
FIGS. 13A to 13C are schematic cross-sectional views illustrating a state in the first embodiment in which the conveyance of the sheet is stopped temporarily when an image is continuously formed on each side of a plurality of sheets.
Figure 13B:
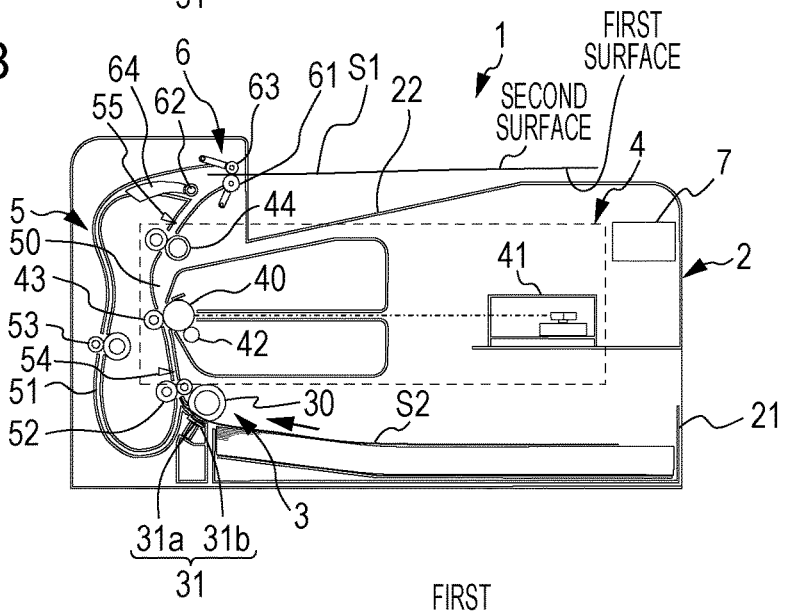
Figure 13C:
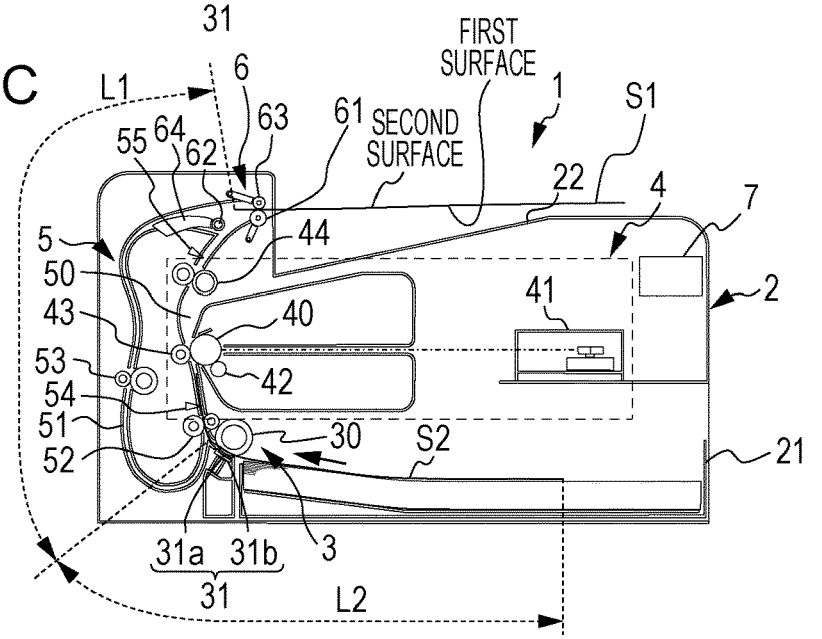

Furthermore, in the present embodiment, when the driving roller 62 is moved, the stopping unit temporarily stops the movement of the driving roller 62 to refine the performance of conveying the sheet S. Referring hereinafter to FIGS. 13A to 13C, a conveyance operation of the sheet S in a case in which the conveyance of the sheet is stopped temporarily in the reversing unit 6 will be described.

FIG. 13A is a schematic cross-sectional view that illustrates a state in which the first sheet S1, on which formation of an image on the first surface has been completed, is conveyed to the reversing unit 6, and a state in which the second sheet S2 has not been fed by the feed roller 30. As illustrated in FIG. 13A, in a case in which feeding of the second sheet S2 with the feed roller 30 is not carried out at a predetermined timing, the interval between the front end of the second sheet S2 and the rear end of the first sheet S1 becomes large compared with a state illustrated in FIG. 10A. More specifically, in a case, for example, in which the operation of feeding the second sheet S2 with the feed roller 30 did not succeed with one operation and the second sheet S2 is fed towards the image forming unit 4 after a plurality of feed operations have been repeated, the interval between the front end of the second sheet S2 and the rear end of the first sheet S1 becomes large.

In a case in which the feeding of the second sheet S2 is delayed and the interval between the first sheet S1 and the second sheet S2 becomes large, the first sheet S1 that has been conveyed in the second direction in the reversing unit 6 may impinge on the second sheet S2 at a position where the first sheet S1 is conveyed from the second conveyance path 51 to the first conveyance path 50. In order to prevent such a mis-conveyance, the sheet interval between the rear end of the first sheet S1 and the front end of the second sheet S2 needs to be controlled.

Accordingly, as illustrated in FIG. 13B, the present embodiment includes a configuration that stops the driving roller 62 at the retracted position when the second sheet S2 has not reached a predetermined position. FIG. 13B is a schematic cross-sectional view illustrating a state in which the driving roller 62 is stopped at the retracted position after moving the driving roller 62 to the retracted position from the initial position with the configuration of the cam drive unit 69. As it has been described in FIGS. 6, 8A, and 8B, by applying power to the solenoid 69*a* and releasing the engagement between the movable piece a1 and the locking portion b3, the cams 67 rotate and the driving roller 62 moves from the initial position to the retracted position. Furthermore, at the timing at which the driving roller 62 reaches the retracted position, by engaging the movable piece a1 and the locking portion b4 together, and by having the input gear 93 and the toothless portion b2 oppose each other, the rotation of the cams 67 is stopped, and the driving roller 62 stops at the retracted position. In the above state, the first sheet S1 is held by the discharge rollers 61 and the reversing rollers 63, and the conveyance of the first sheet S1 stops.

FIG. 13C is a schematic cross-sectional view illustrating a state before the driving roller 62 is moved from the retracted position to the initial position by applying power to the solenoid 69*a* once more and rotating the cams 67. In the present embodiment, power is applied to the solenoid 69*a* once again after a predetermined timing has passed from when the front end of the second sheet S2 fed by the feed roller 30 has been detected by the first sensor 54. Note that the predetermined timing is a timing at which the sheet interval between the rear end of the first sheet S1 that has stopped being conveyed and the front end of the second sheet S2 is determined to have satisfied a predetermined relationship. As it has been described in FIGS. 6, 8B, and 8C, by applying power to the solenoid 69*a* once more, the engagement between the movable piece a1 and the locking portion b4 is released, the cams 67 rotate, and the driving roller 62 starts to move from the retracted position to the initial position. As described above, by applying power to the solenoid 69*a* in accordance with the detection result of the first sensor 54, the sheet interval between the rear end of the first sheet S1 and the front end of the second sheet S2 can be maintained at a predetermine interval at all times.

Note that as illustrated in FIG. 13C, the timing at which the driving roller 62 is moved from the retracted position to the initial position needs to satisfy at least the following condition. In other words, a length L2 from a junction between the first conveyance path 50 and an exit side of the second conveyance path 51 to the rear end of the second sheet S2 needs to be shorter than a length L1 from the front end of the first sheet S1 that has stopped being conveyed to the junction between the first conveyance path 50 and the second conveyance path 51. By moving the driving roller 62 and conveying the first sheet S1 after the length L2 has become shorter than the length L1, the first sheet S1 that has passed through the second conveyance path 51 and that has reached the first conveyance path 50 can be avoided from impinging on the second sheet S2.

As described above, in the present embodiment, the driving roller 62 can be stopped at the retracted position owing to the configuration of the cam drive unit 69. Note that since the discharge rollers 61 and the reversing rollers 63 are driven rollers and no drive is input thereto, while the driving roller 62 is stopped at the retracted position, the conveyance of the sheet S that is nipped by the discharge rollers 61 and the reversing rollers 63 stops in the reversing unit 6. The above configuration allows the sheet interval between a preceding sheet S and a succeeding sheet S to be controlled when a plurality of sheets S are conveyed, and the conveying timing of each sheet S can be adjusted.

Note that in order to perform the movements in FIGS. 8A to 8C, in the present embodiment, power is applied twice to the solenoid 69*a* while the cams 67 rotate once. In other words, power is applied once when the driving roller 62 is moved from the initial position to the retracted position and, subsequently, in order to move the driving roller 62 from the retracted position to the initial position, power is applied once more after the predetermined timing has passed after the first sensor 54 has detected the front end of the second sheet. However, the present disclosure is not limited to the above configuration. For example, after turning the power status of the solenoid 69*a* to ON, when the first sensor 54 detects the front end of the second sheet S2, the power status is maintained so that the locking portion b4 and the movable piece a1 do not become engaged with each other, and the cam 67 is rotated once without any stoppage in between. On the other hand, after turning the power status of the solenoid 69*a* to OFF, when the first sensor 54 does not detect the front end of the second sheet S2 within the time the first sensor 54 is to detect the front end of the second sheet S2, the power status of the solenoid 69*a* is turned OFF. By turning the power status of the solenoid 69*a* to OFF, the locking portion b4 and the movable piece a1 are engaged with each other and the rotation of the cams 67 is stopped once. With the above, the driving roller 62 is stopped at the retracted position, and after the predetermined timing has passed after the first sensor 54 detected the front end of the second sheet S2, the power status is turned to ON once more, and the driving roller 62 is moved from the retracted position to the initial position.

Furthermore, in the present embodiment, the cam drive unit 69 is configured so that, when the driving roller 62 reaches the retracted position, the movement stops; however, the position stopping the driving roller 62 does not have to be the retracted position. By adjusting the positions where the toothless portion b1 and the toothless portion b2 of the partially-toothless gear 69*b* are provided, and adjusting the positions where the locking portion b3, and the locking portion b4 are provided, the driving roller 62 can be stopped at any position from the initial position to the retracted position while a similar effect as that of the present embodiment is obtained.

As described above, in the present embodiment, by moving the driving roller 62, the sheet S that had been conveyed in the first direction in the first nip portions N1 can be moved to the second nip portions N2 so that the sheet S is conveyed in the second direction. In other words, the sheet S conveyed to the reversing unit 6 can be switched between a state in which the sheet S is nipped by the first nip portions N1 and a state in which the sheet S is nipped by the second nip portions N2 with the operation of moving the driving roller 62. With the above, the first nip portions N1 can be emptied, and the second sheet S2 can be conveyed in the first direction by the first nip portions N1 while the first sheet S1 is conveyed in the second direction by the second nip portions N2 in a case in which an image is formed on both surfaces of a plurality of sheets S. Furthermore, in the case of the second sheet S2 as well, similar to the first sheet S1, the second sheet S2 that has been conveyed in the first direction in the first nip portions N1 can be nipped in the second nip portions N2 and be conveyed in the second direction by moving the driving roller 62. With the above, the first nip portions N1 can be emptied, and the first sheet S1 on which an image has been formed on both surfaces can be conveyed to the first nip portions N1 while the second sheet S2 is conveyed in the second direction. As a result, the passing-by conveyance of the first sheet S1 and the second sheet S2 can be performed efficiently in the reversing unit 6, and the efficiency in conveying the sheet S can be refined.

Furthermore, in the configuration of the present embodiment, when the first sheet S1 is conveyed in the second direction, the second sheet S2 can be conveyed to the reversing unit 6; accordingly, the conveyance interval between the first sheet S1 and the second sheet S2 can be shortened. The discharge of the second sheet S2 on which an image has been formed on both sides can be performed in a shorter time in proportion to the shortened conveyance interval between the first sheet S1 and the second sheet S2.

Second Embodiment

The levers 74 that move in conjunction with the discharge rollers 71 have been described in the first embodiment. Conversely, in a second embodiment, as illustrated in FIGS. 14 and 15A to 15D, levers 201 serving as regulating members that move while interlocking with the driving roller holders 65 will be described. Note that in the description hereinafter, portions that are common with those of the first embodiment are denoted with the same reference numerals as those of the first embodiment and description thereof is omitted.

Figure 14:
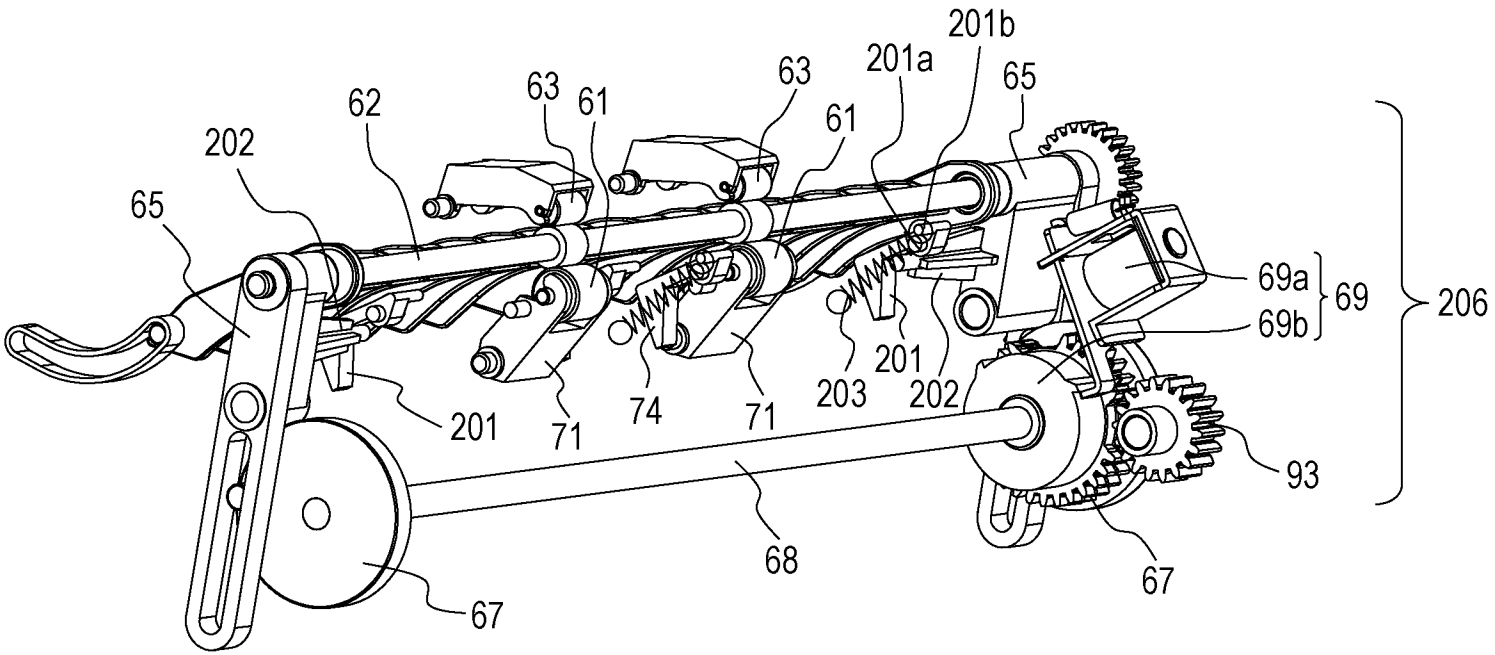
FIG. 14 is a schematic diagram illustrating a configuration of a reversing unit according to a second embodiment.

FIG. 14 is a schematic diagram illustrating a reversing unit 206 of the present embodiment. As illustrated in FIG. 14, the levers 201 are pivotable about rotation fulcrums 201*a*, and are urged with springs 203 hooked to spring hooking portions 201*b*. Similar to the first embodiment, directions in which the levers 201 are urged with the springs 203 change depending on the positions of the levers 201. Furthermore, the driving roller holders 65 are, in an integrated manner, provided with protrusions 202 that interlock with the levers 201.

Note that as illustrated in FIG. 14, in the present embodiment, two discharge rollers 61 and two reversing rollers 63 are provided in the axial direction of the driving roller 62. Description thereof will be described. However, not limited to the above configuration, even in a case as in the first embodiment in which four discharge rollers 61 and four reversing rollers 63 are disposed in the axial direction of the driving roller 62, a similar effect as that of the present embodiment can be obtained. Furthermore, similar to the first embodiment, the levers 74 provided at a middle portion interlocks with the discharge roller holders 71.

Referring next to FIGS. 15A to 15D, the operation of moving the driving roller 62 in the reversing unit 206 when switching from the state in which the sheet S is nipped by the first nip portions N1 to the state in which the sheet S is nipped by the second nip portions N2, and an operation of the levers 201 will be described.

Figure 15A:
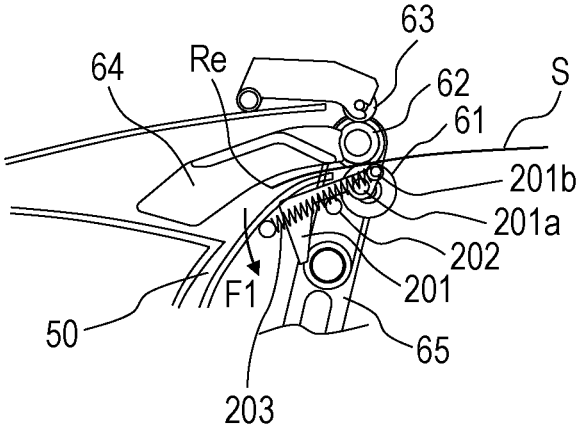
FIGS. 15A to 15D are schematic diagrams illustrating an operation of the reversing unit according to the second embodiment.

As illustrated in FIG. 15A, when the driving roller 62 is at the initial position, the levers 201 are urged with the springs 203 in the arrow F1 direction illustrated in the drawing and are abutted against the protrusions 202 of the driving roller holders 65. With the above, the levers 201 are held at positions retracted from the first conveyance path 50 and do not come in contact with the sheet S conveyed in the first direction. Note that in the above state, the sheet S is nipped by the first nip portions N1 formed between the driving roller 62 and the discharge rollers 61 and is conveyed in the first direction along the first conveyance path 50.

Figure 15B:
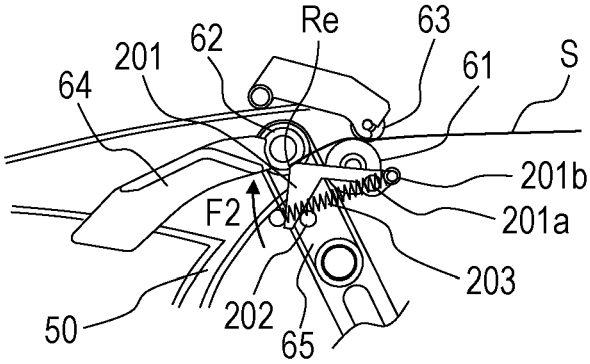

By actuating the solenoid 69*a* at a timing at which the sheet S has reached a predetermined position, the driving roller 62 starts to move from the initial position towards the retracted position. As illustrated in FIG. 15B, when the driving roller 62 moves, the protrusions 202 are moved by the rotation of the driving roller holders 65, and the levers 201 pivot in the arrow F2 direction illustrated in the drawing. As a result, the levers 201 urged by the springs 203 are pushed up in a direction protruding the levers 201 into the first conveyance path 50, and come into contact with the sheet S from the discharge roller 61 side.

Figure 15C:
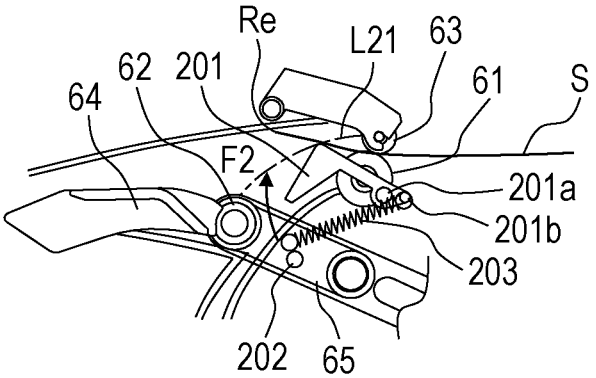

FIG. 15C is a schematic diagram illustrating a state of the sheet S when the driving roller 62 has moved to the retracted position (the second position) in which the moved amount of the driving roller 62 is the largest. The driving roller 62 moves upstream with respect to the rear end of the sheet S, the sheet S being in contact with the driving roller 62 and the discharge rollers 61 in the first nip portions N1, in the conveying direction of the sheet S in the first nip portions N1.

When the driving roller 62 moves from the initial position to the retracted position, the levers 201, with the urging force of the springs 203, are rotated further in the arrow F2 direction illustrated in the drawing, and are then regulated with stoppers (not shown). With the above, as illustrated in FIG. 15C, the levers 201 are held at positions the lift the rear end Re of the sheet S towards the reversing rollers 63. By being lifted by the levers 201, similar to the first embodiment, the rear end Re of the sheet S is lifted above the moving trajectory L21 of the outer peripheral surface of the driving roller 62.

Figure 15D:
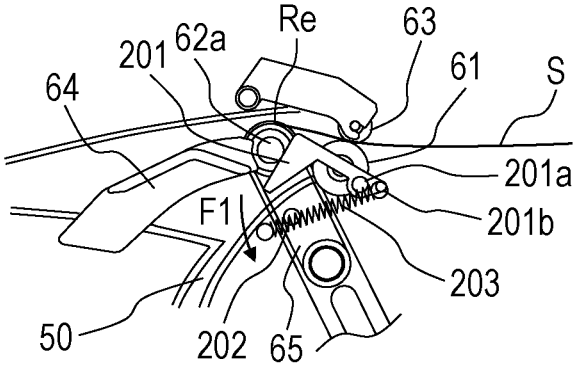

FIG. 15D is a schematic diagram illustrating a state of the sheet S when the solenoid 69*a* has been actuated once more and the driving roller 62 is in the course of moving from the retracted position to the initial position. The driving roller 62 moves from the retracted position to the initial position by approaching the discharge rollers 61 and the reversing rollers 63 from the undersurface side of the sheet S nipped by the third nip portions N3, in other words, from the side on which the surface of the sheet S against which the discharge roller had been in contact with is situated.

When the driving roller 62 moves to return to the initial position, as illustrated in FIG. 15D, the shaft portion 62*a* of the driving roller 62 abuts against each lever 201. Subsequently, when the driving roller 62 further moves towards the initial position, the levers 201 are pushed by the shaft portion 62*a* of the driving roller 62 and are rotated in the arrow F1 direction illustrated in the drawing. Note that similar to the first embodiment, in the configuration of the present embodiment as well, when the levers 201 and the shaft portion 62*a* are abutted against each other, a portion of each rubber roller portion 62*b* is, in the first direction, positioned downstream of the corresponding lever 201 lifting the rear end Re of the sheet S.

Accordingly, the driving roller 62 enters a portion on the undersurface side (the lower side in the gravitational direction) of the sheet S by the time the state in which the rear end Re of the sheet S is lifted by the levers 201 is cancelled with the rotation of the levers 201 in the arrow F1 direction illustrated in the drawing. In other words, the operation of the levers 201 suppresses the driving roller 62 from impinging against the rear end Re of the sheet S or from returning to an upper surface side of the sheet S once more, while the driving roller 62 moves from the retracted position to the initial position.

Subsequently, when the driving roller 62 reaches the initial position and when the third nip portions N3 is eliminated and the first nip portions N1 and the second nip portions N2 are formed, the levers 201 are held at the position retracted from the first conveyance path 50 after rotating in the arrow F1 direction illustrated in the drawing. Subsequently, the sheet S is conveyed in the second direction while being nipped in the second nip portions N2.

As described above, a similar effect as that of the first embodiment can be obtained in the present embodiment as well. Furthermore, with the configuration of the present embodiment, as illustrated in FIG. 14, end portions of the sheet S in the width direction intersecting the conveying direction of the sheet S can be lifted with the levers 201. With the above, the driving roller 62 that has moved from the initial position to the retracted position can be moved towards the initial position from the undersurface side of the sheet S in a stable manner, and a decrease in the sheet conveying performance can be suppressed.

Third Embodiment

The levers 74 that move in conjunction with the discharge rollers 71 have been described in the first embodiment. Conversely, in a third embodiment, as illustrated in FIGS. 16, and 17A to 17D, levers 211 serving as regulating members that move while interlocking with cams 67 that move the driving roller 62 will be described. Note that in the description hereinafter, portions that are common with those of the first embodiment are denoted with the same reference numerals as those of the first embodiment and description thereof is omitted.

Figure 16:
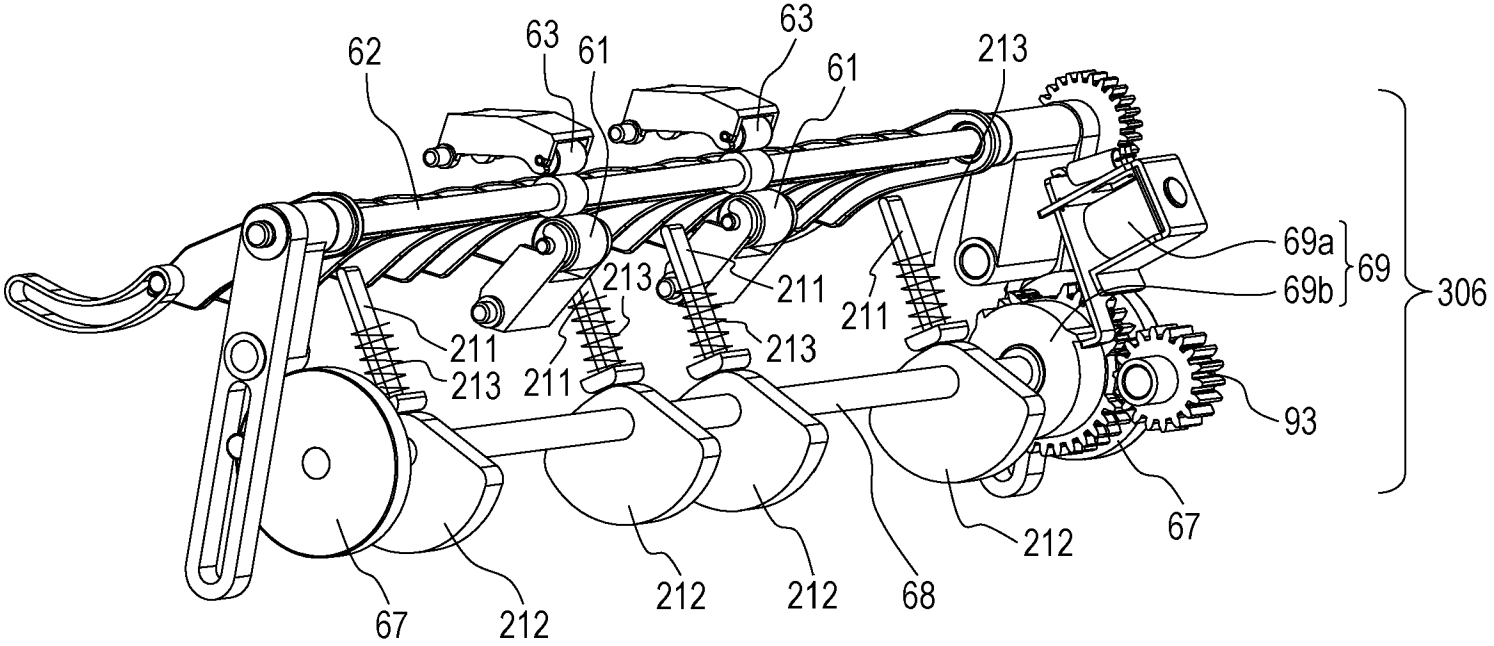
FIG. 16 is a schematic diagram illustrating a configuration of a reversing unit according to a third embodiment.

FIG. 16 is a schematic diagram illustrating a reversing unit 306 of the present embodiment. As illustrated in FIG. 16, the levers 211 are provided in a state allowing first end sides of the levers 211 to protrude into and retract from the first conveyance path 50. Furthermore, second end sides of the levers 211 are urged by compression springs 213 to be urged against outer peripheral surfaces of lever cams 212 (cam members) provided on the cam shaft 68, Referring next to FIGS. 17A to 17D, the operation of moving the driving roller 62 in the reversing unit 306 when switching from the state in which the sheet S is nipped by the first nip portions N1 to the state in which the sheet S is nipped by the second nip portions N2, and an operation of the levers 211 will be described.

Figure 17A:
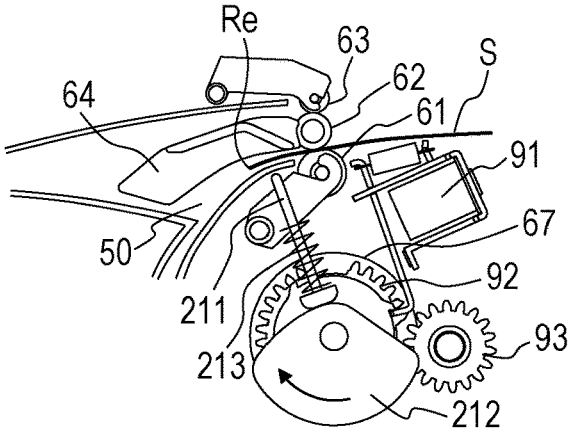
FIGS. 17A to 17D are schematic diagrams illustrating an operation of the reversing unit according to the third embodiment.

As illustrated in FIG. 17A, when the driving roller 62 is at the initial position, the levers 211 are, with the springs 213, each urged against an outer periphery of the corresponding lever cam 212 where the radius is small. In so doing, the levers 211 are held at positions retracted from the first conveyance path 50 and do not come in contact with the sheet S conveyed in the first direction.

Figure 17B:
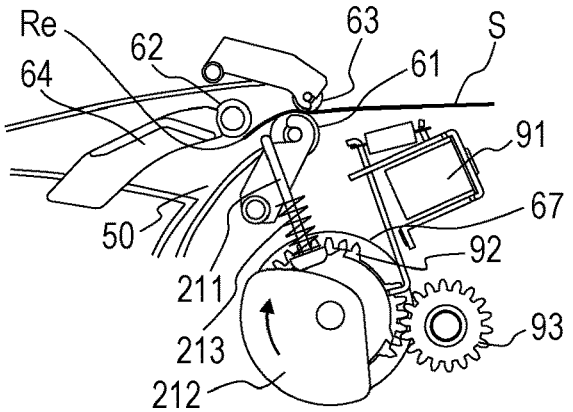

By actuating the solenoid 69*a* at a timing at which the sheet S has reached a predetermined position, the driving roller 62 starts to move from the initial position towards the retracted position. As illustrated in FIG. 17B, when the driving roller 62 moves, the lever cams 212 disposed on the same cam shaft 68 as that of the cams 67 rotate in the arrow direction illustrated in the figure. With the rotation of the lever cams 212, the levers 211 gradually move along the outer peripheral surfaces of the lever cams 212 and in an arrow F3 direction illustrated in the drawing and comes into contact with the sheet S from the discharge roller 61 side after being pushed up in a direction protruding the levers 211 into the first conveyance path 50.

Figure 17C:
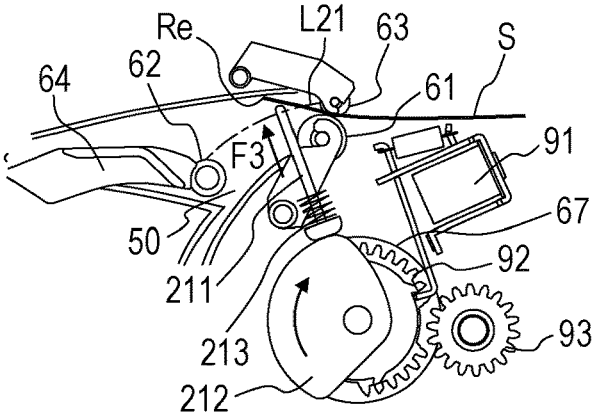

FIG. 17C is a schematic diagram illustrating a state of the sheet S when the driving roller 62 has moved to the retracted position (the second position) in which the moved amount of the driving roller 62 is the largest. The driving roller 62 moves upstream with respect to the rear end of the sheet S, the sheet S being in contact with the driving roller 62 and the discharge rollers 61 in the first nip portions N1, in the conveying direction of the sheet S in the first nip portions N1.

As illustrated in FIG. 17C, when the driving roller 62 moves from the initial position to the retracted position, the levers 211 are further pushed up with the lever cams 212 in the arrow F3 direction illustrated in the drawing and are held at positions that hold up the rear end Re of the sheet S towards the reversing rollers 63. In so doing, similar to the first embodiment, by being lifted by the levers 211, the rear end Re of the sheet S is lifted above the moving trajectory L21 of the outer peripheral surface of the driving roller 62.

Figure 17D:
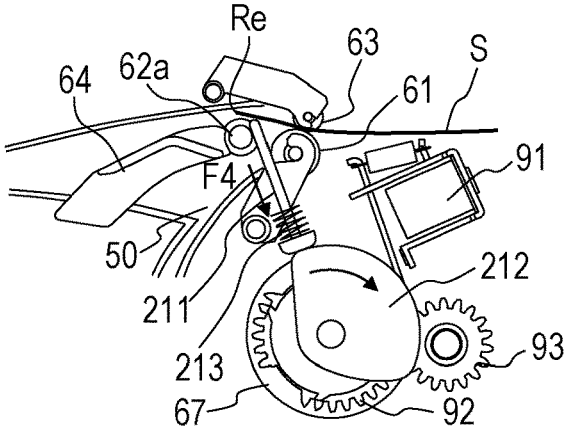

FIG. 17D is a schematic diagram illustrating a state of the sheet S when the solenoid 69*a* has been actuated once more and the driving roller 62 is in the course of moving from the retracted position to the initial position. In the present embodiment, the shapes of the lever canis 212 are set so that when the driving roller 62 moves to the initial position, the levers 211 maintain a state in which the levers 211 lift up the rear end Re of the sheet S until reaching the position illustrated in FIG. 17D. Accordingly, similar to the first embodiment, when the levers 211 and the shaft portion 62*a* of the driving roller 62 are abutted against each other, a portion of each rubber roller portion 62*b* is, in the first direction, positioned downstream of the corresponding lever 211 lifting the rear end Re of the sheet S.

Accordingly, by having the levers 211 move in the arrow F4 direction illustrated in the drawing with the rotation of the lever cams 212, the driving roller 62 enters a portion on the undersurface side of the sheet S by the time the state in which the rear end Re of the sheet S is lifted by the levers 211 is cancelled. In other words, the operation of the levers 211 suppresses the driving roller 62 from impinging against the rear end Re of the sheet S or from returning to an upper surface side of the sheet S once more, while the driving roller 62 moves from the retracted position to the initial position.

Subsequently, when the driving roller 62 reaches the initial position and when the third nip portions N3 is eliminated and the first nip portions N1 and the second nip portions N2 are formed, the levers 211 are held at the position retracted from the first conveyance path 50 after moving in the arrow F4 direction illustrated in the drawing. Subsequently, the sheet S is conveyed in the second direction while being nipped in the second nip portions N2.

As described above, a similar effect as that of the first embodiment can be obtained in the present embodiment as well.

Another Embodiment

Figure 18:
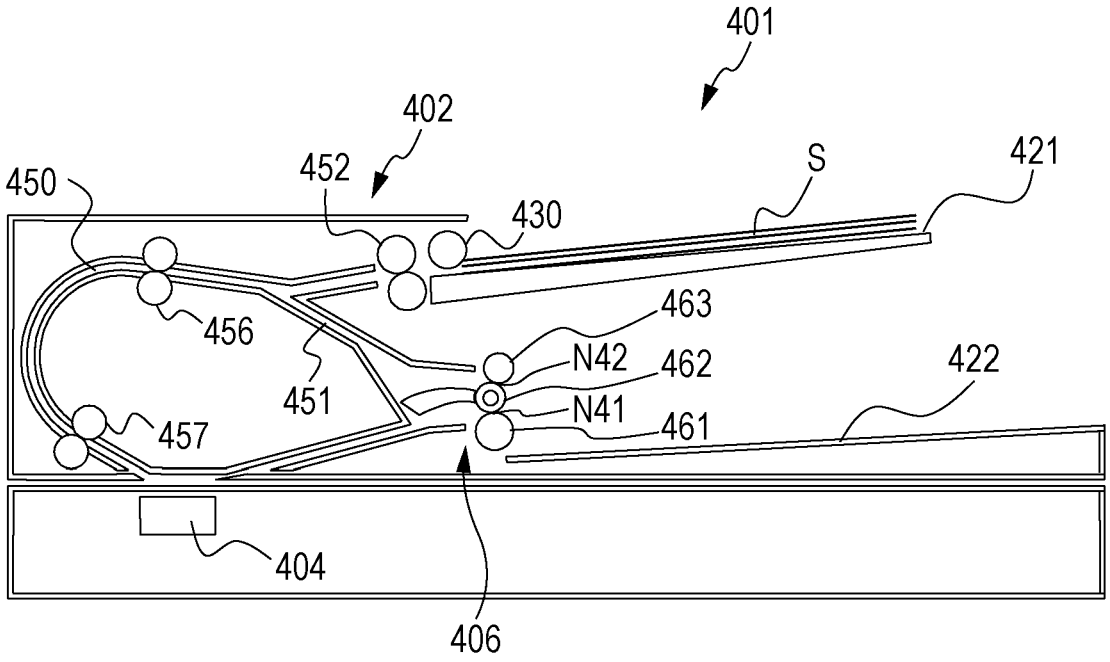
FIG. 18 is a schematic cross-sectional view illustrating a sheet conveying apparatus according to another embodiment.

While the embodiments in which the sheet conveying apparatus is used in an image forming apparatus has been described above, the sheet conveying apparatus according to the present disclosure is not limited to the above. The present disclosure can be used in any apparatus that changes the conveying direction of the sheet S from the first conveying direction to the second conveying direction, and an effect similar to that of the embodiments of the present disclosure can be obtained with such an apparatus. In other words, as illustrated in FIG. 18, the present disclosure can be applied to an image reading apparatus that reads an image on the conveyed sheet S, and a similar effect can be obtained with the image reading apparatus.

An image reading apparatus 401 that is a sheet conveying apparatus according to the present embodiment includes an image reading unit 404 that reads an image on the conveyed sheet S. Note that a configuration of a reversing unit 406 according to the present embodiment is similar to that of the first embodiment. Accordingly, the points of the configuration of the image reading apparatus 401 and points of the method of reading images on both surfaces of the sheet S that are different from those of the first embodiment will be described mainly, and description of the points that are similar to those of the first embodiment will be omitted.

The sheets S that are stored in a sheet feed tray 421 serving as a storage portion are fed by the rotation of a feed roller 430, and are separated into singe sheets with a separation unit 452. Subsequently, the sheet S is conveyed to the image reading unit 404 through a first conveyance path 450 with pairs of conveyance rollers 456 and 457, and an image on a first surface of the sheet S is read with the image reading unit 404. The sheet S having been read the image on the first surface is conveyed to the reversing unit 406, and is nipped in a first nip portion N41 formed between a driving roller 462 (a first rotating member) and a discharge roller 461 (a second rotating member). With the rotation of the driving roller 462, the sheet S nipped by the driving roller 462 and the discharge roller 461 is conveyed from the driving roller 462 towards a sheet discharge tray 422 serving as a stack unit, and is conveyed in a direction (a first direction) that is a direction in which the sheet S is discharged from the apparatus main body 402. Subsequently, the driving roller 462 starts to move before the rear end of the sheet S is conveyed to the sheet discharge tray 422 with the driving roller 462 and the discharge roller 461.

With the movement of the driving roller 462, the sheet S that had been nipped by the first nip portion N41 is nipped at a second nip portion N42 formed by the driving roller 462 and a reversing roller 463, and is conveyed in a direction (a second direction) extending from the sheet discharge tray 422 towards a second conveyance path 451. Subsequently, the sheet S is conveyed once more to the image reading unit 404 through the first conveyance path 450 with the pairs of conveyance rollers 456 and 457, and an image on a second surface of the sheet S is read with the image reading unit 404. The sheet S having been read the image on both the first surface and the second surface is conveyed to the first nip portion N41 once again, and is discharged to the sheet discharge tray 422 after being conveyed in the first direction in the first nip portion N41.

As described above, in the present embodiment as well, by moving the driving roller 462 of the reversing unit 406, the sheet S that had been nipped in the first nip portion N41 can be nipped in the second nip portion N42 without completely discharging the sheet S from the reversing unit 406. Similar to the reversing unit 6 of the first embodiment, the reversing unit 406 includes a switching unit that switches between the nipped states of the sheet S. Accordingly, the reversing unit 406 is capable of switching the nip portion in which the sheet S is nipped from the first nip portion N41 to the second nip portion N42 before the rear end of the sheet S conveyed in the first direction is conveyed through the first nip portion N41. As described above, the present disclosure can be applied to the image reading apparatus that reads an image on the conveyed sheet S, and an effect that is similar to that of the first embodiment can be obtained with the image reading apparatus.

Moreover, while in the embodiments described above, examples in which the present disclosure is applied to an electrophotographic image forming apparatus has been given, the present disclosure is not limited to the above. For example, the present disclosure may be applied to image forming apparatuses other than electrophotographic image forming apparatuses, such as ink jet image forming apparatuses.

While the present disclosure has been described with reference to embodiments, it is to be understood that the disclosure is not limited to the disclosed embodiments. The scope of the following claims is to be accorded the broadest interpretation to encompass all such modifications and equivalent structures and functions.

This application claims the benefit of Japanese Patent Application No. 2017-193777 filed Oct. 3, 2017 which is hereby incorporated by reference herein in its entirety.

What is claimed is:

1. A sheet conveying apparatus comprising:

a first rotating member configured to rotate in one direction;

a second rotating member configured to convey a sheet in a first direction together with the first rotating member according to the first rotating member rotating;

a third rotating member configured to convey the sheet in a second direction together with the first rotating member according to the first rotating member rotating, wherein the second direction is a direction different from the first direction;

a switching unit configured to switch a position of the first rotating member between a first position and a second position, wherein the first position is a position in which the first rotating member coveys a sheet with the second rotating member or the third rotating member and the second position is a position to which the first rotating member is retracted from the first position; and a regulating member configured to regulate a position of the sheet, wherein, in a case where the first rotating member moves from the first position, the regulating member regulates the position of the sheet so that a rear end of the sheet held by the second rotating member and the third rotating member is, in a gravitational direction, positioned above a moving trajectory of the first rotating member.

2. The sheet conveying apparatus according to claim 1, wherein, in a state in which the second rotating member is in contact with a first surface of the sheet and in which the first rotating member is in contact with a second surface that is a surface opposite the first surface of the sheet, the switching unit moves the first rotating member from the first position towards the second position.

3. The sheet conveying apparatus according to claim 2, wherein, in a state in which the sheet is held by the second rotating member and the third rotating member, by having the switching unit move the first rotating member from the second position to the first position, the first rotating member comes in contact with the first surface of the sheet, and the third rotating member comes in contact with the second surface of the sheet.

4. The sheet conveying apparatus according to claim 2, wherein, in a state in which the sheet is held by the second rotating member and the third rotating member, the second rotating member and the regulating member are in contact with the first surface of the sheet, and the third rotating member is in contact with the second surface of the sheet.

5. The sheet conveying apparatus according to claim 1, further comprising:

a holding member configured to hold the second rotating member; and a first urging member configured to urge the second rotating member towards the first rotating member by urging the holding member, wherein, while the switching unit moves the first rotating member from the first position to the second position, the holding member moves by the being urged by the urging member and the regulating member moves in conjunction with the holding member.

6. The sheet conveying apparatus according to claim 5, further comprising a second urging member, wherein a first end portion of the second urging member is fixed to a main body of the sheet conveying apparatus, and a second end portion of the second urging member is fixed to an engagement portion provided in the regulating member, and wherein, by being urged by the second urging member, the regulating member pivots towards a side that is opposite to a side on which a rotation fulcrum of the regulating member is situated with respect to a line segment connecting the first end portion and the second end portion of the second urging member, and moves to a position that regulates a position of the sheet.

7. The sheet conveying apparatus according to claim 1, wherein the switching unit includes a support member configured to support both ends of the first rotating member in a direction intersecting a sheet conveying direction and to move the first rotating member from the first position to the second position, and wherein, while the switching unit moves the first rotating member from the first position to the second position, the regulating member moves in conjunction with the support member.

8. The sheet conveying apparatus according to claim 7, further comprising a second urging member, wherein a first end portion of the second urging member is fixed to the support member, and a second end portion of the second urging member is fixed to an engagement portion provided in the regulating member, and wherein, by being urged by the second urging member, the regulating member pivots towards a side that is opposite to a side on which a rotation fulcrum of the regulating member is situated with respect to a line segment connecting the first end portion and the second end portion of the second urging member, and moves to a position that regulates a position of the sheet.

9. The sheet conveying apparatus according to claim 1, further comprising:

a cam member configured to rotate while being interlocked with an operation of the switching unit that moves the first rotating member; and a spring configured to urge the regulating member against an outer peripheral surface of the cam member, wherein, while the switching unit moves the first rotating member from the first position to the second position, the regulating member, with a rotation of the cam member, moves above a moving trajectory of the first rotating member in a gravitational direction and regulates a position of the sheet.

10. The sheet conveying apparatus according to claim 1, wherein the rear end of the sheet is, in the first direction, a rear end of the sheet conveyed in the first direction with the first rotating member and the second rotating member.

11. The sheet conveying apparatus according to claim 1, further comprising a stopping unit configured to stop a movement of the first rotating member at any position between the first position and the second position, wherein, by having the stopping unit stop the first rotating member at any position between the first position and the second position after the switching unit has moved the first rotating member from the first position to the second position, the conveyance of the sheet is stopped while the sheet is held by the second rotating member and the third rotating member.

12. The sheet conveying apparatus according to claim 1, wherein the first rotating member receiving driving force from a drive source rotates only in one direction, and wherein, while the first rotating member moves between the first position and the second position, the first rotating member receiving the driving force from the drive source continues to rotate.

13. The sheet conveying apparatus according to claim 1, wherein the second rotating member and the third rotating member are rotated by following the rotation of the first rotating member.

14. The sheet conveying apparatus according to claim 1, wherein the second rotating member contacting the first rotating member forms a first nip portion, and the third rotating member contacting the first rotating member forms a second nip portion at a position different from the position at which the second rotating member is in contact with the first rotating member in a circumferential direction.

15. The sheet conveying apparatus according to claim 1, further comprising:

a stack unit on which a discharged sheet is to be stacked;

a first conveyance path configured to convey the sheet towards the first rotating member and the second rotating member; and a second conveyance path configured to convey the sheet, which has been conveyed in the first direction with the first rotating member and the second rotating member, to the conveyance path once again, wherein the first direction is a direction in which the sheet is conveyed from the first rotating member towards the stack unit by the first rotating member and the second rotating member, and wherein the second direction is a direction in which the sheet is conveyed from the stack unit towards the second conveyance path by the first rotating member and the third rotating member.

16. The sheet conveying apparatus according to claim 15, further comprising a storage portion configured to store the sheet, wherein, by the first rotating member and the second rotating member, the sheet fed from the storage portion to the first conveyance path or the sheet conveyed from the second conveyance path to the first conveyance path is conveyed in the first direction.

17. An image forming apparatus comprising:

an image forming unit configured to form an image on a sheet;

a first rotating member configured to rotate in one direction and convey the sheet on which an image has been formed in the image forming unit;

a second rotating member configured to convey the sheet in a first direction together with the first rotating member according to the first rotating member rotating;

a third rotating member that configured to convey the sheet in a second direction together with the first rotating member according to the first rotating member rotating, wherein the second direction is a direction different from the first direction;

a switching unit configured to switch a position of the first rotating member between a first position and a second position, wherein the first position is a position in which the first rotating member coveys a sheet with the second rotating member or the third rotating member and the second position is a position to which the first rotating member is retracted from the first position; and a regulating member configured to regulate a position of the sheet, wherein, in a case where the first rotating member moves from the first position, the regulating member regulates the position of the sheet so that a rear end of the sheet held by the second rotating member and the third rotating member is, in a gravitational direction, positioned above a moving trajectory of the first rotating member.

18. An image reading apparatus comprising:

an image reading unit configured to read an image formed on a sheet;

a first rotating member configured to rotate in one direction and convey the sheet from which an image is to be read in the image reading unit;

a second rotating member configured to convey the sheet in a first direction together with the first rotating member according to the first rotating member rotating;

a third rotating member configured to convey the sheet in a second direction together with the first rotating member according to the first rotating member rotating, wherein the second direction is a direction different from the first direction;

a switching unit configured to switch a position of the first rotating member between a first position and a second position, wherein the first position is a position in which the first rotating member coveys a sheet with the second rotating member or the third rotating member and the second position is a position to which the first rotating member is retracted from the first position; and a regulating member configured to regulate a position of the sheet, wherein, in a case where the first rotating member moves from the first position, the regulating member regulates the position of the sheet so that a rear end of the sheet held by the second rotating member and the third rotating member is, in a gravitational direction, positioned above a moving trajectory of the first rotating member.

* * * * *